US005525266A

United States Patent [19]

Thompson

[11] Patent Number: 5,525,266

[45] Date of Patent: Jun. 11, 1996

[54] POWER VAPOR NOZZLE AND SPLASH PLATE

[75] Inventor: Richard W. Thompson, Tujunga, Calif.

[73] Assignee: Thompson Technologies, Inc., Glendale, Calif.

[21] Appl. No.: 234,412

[22] Filed: Apr. 28, 1994

Related U.S. Application Data

[63] Continuation of Ser. No. 166,974, Dec. 14, 1993, which is a continuation-in-part of Ser. No. 917,203, Jul. 17, 1992, abandoned, which is a continuation-in-part of Ser. No. 806,907, Dec. 13, 1991, abandoned.

[51] Int. Cl.[6] ..... F02M 29/04

[52] U.S. Cl. ..... 261/34.1; 239/498; 261/34.2; 261/78.1; 261/78.2; 261/DIG. 39

[58] Field of Search ..... 261/34.1, 78.1, 261/DIG. 39, 78.2, 34.2; 239/498

[56] References Cited

U.S. PATENT DOCUMENTS

| | | | |
|---|---|---|---|
| 1,434,757 | 11/1922 | Thomas | 239/498 |
| 1,977,661 | 10/1934 | Whitehurst . | |
| 2,364,987 | 12/1944 | Lee . | |
| 2,621,031 | 12/1952 | Gonzalez et al. | 261/75 |
| 2,704,659 | 3/1955 | Fuchs | 261/DIG. 39 |
| 3,081,949 | 3/1963 | Simmons | 239/383 |
| 3,467,072 | 9/1969 | Toesca . | |
| 4,012,468 | 3/1977 | Kikuchi . | |
| 4,105,003 | 8/1978 | Funk | 261/78.1 |
| 4,347,823 | 9/1982 | Kessler . | |
| 4,478,607 | 10/1984 | Capps . | |
| 4,574,760 | 3/1986 | Jones et al. | 261/DIG. 39 |
| 4,968,458 | 11/1990 | Besnia . | |

FOREIGN PATENT DOCUMENTS

| | | | |
|---|---|---|---|
| 890 | 4/1903 | France . | |
| 316475 | 4/1903 | France | 261/78.2 |
| 1092646 | 4/1955 | France . | |
| 2555253 | 5/1985 | France . | |
| 423738 | 1/1925 | Germany . | |
| 849320 | 9/1952 | Germany . | |
| 04914 | of 1914 | United Kingdom . | |
| 314924 | 8/1929 | United Kingdom . | |

*Primary Examiner*—James P. Mackey
*Attorney, Agent, or Firm*—Ladas & Parry

[57] ABSTRACT

Disclosed in this description are modified accelerator pumps, fuel ports, venturis and carburetor openings. These modifications include the use of power vapor nozzles. All are used on fuel injection and standard engines and assist in the homogenization of incoming fuel with incoming air to reduce pollutants and fuel usage.

12 Claims, 32 Drawing Sheets

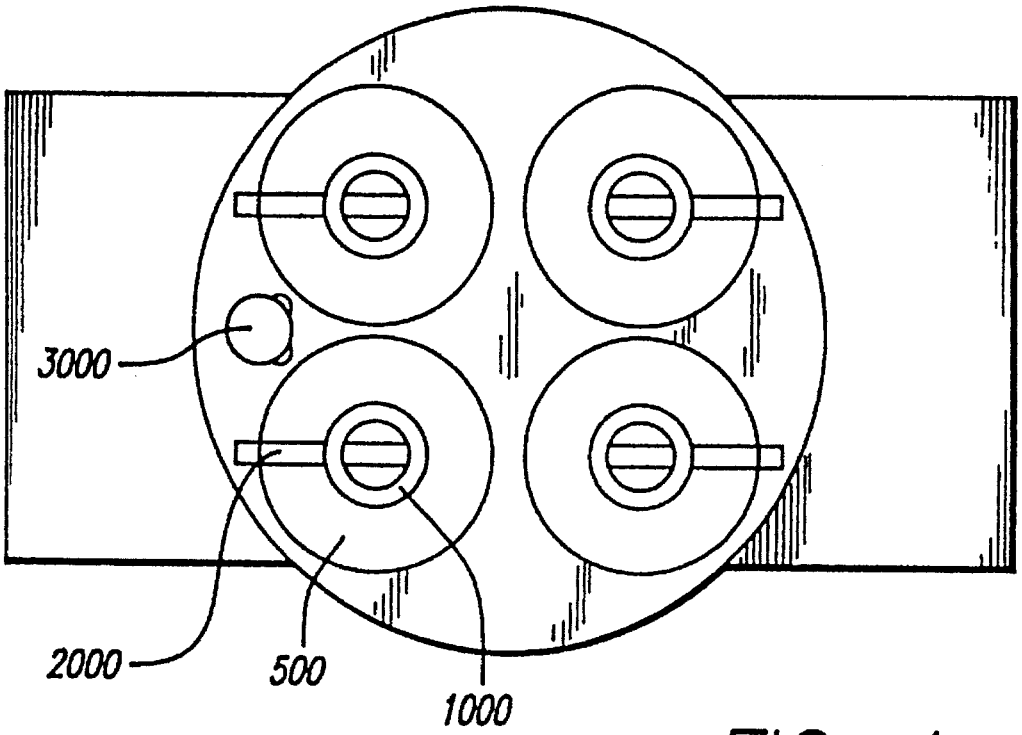
FIG. A
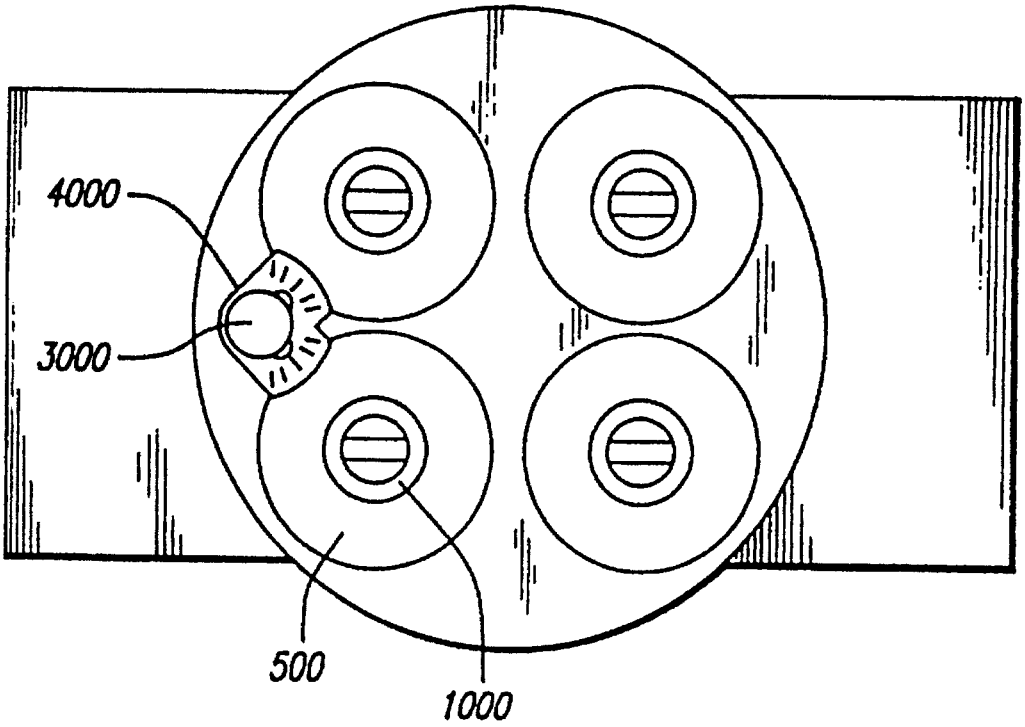
FIG. B

FIG. 8a
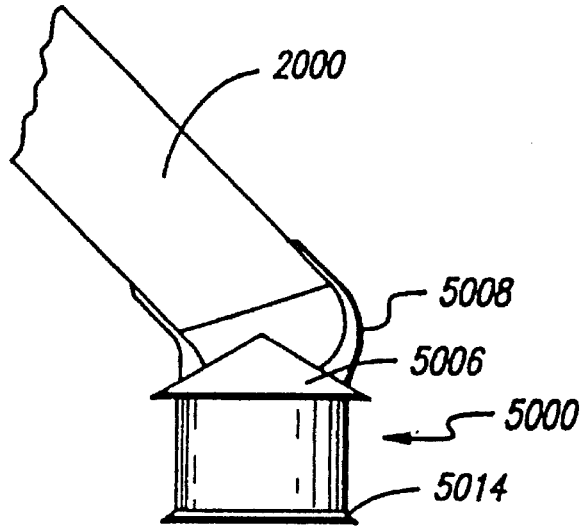
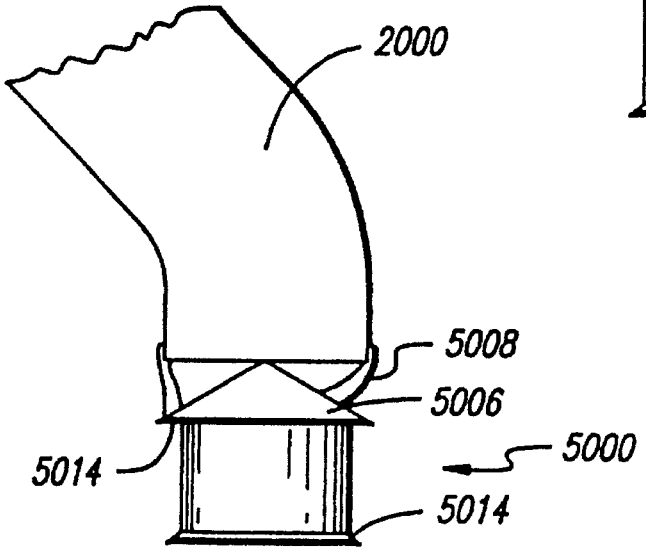
FIG. 8b
FIG. 10
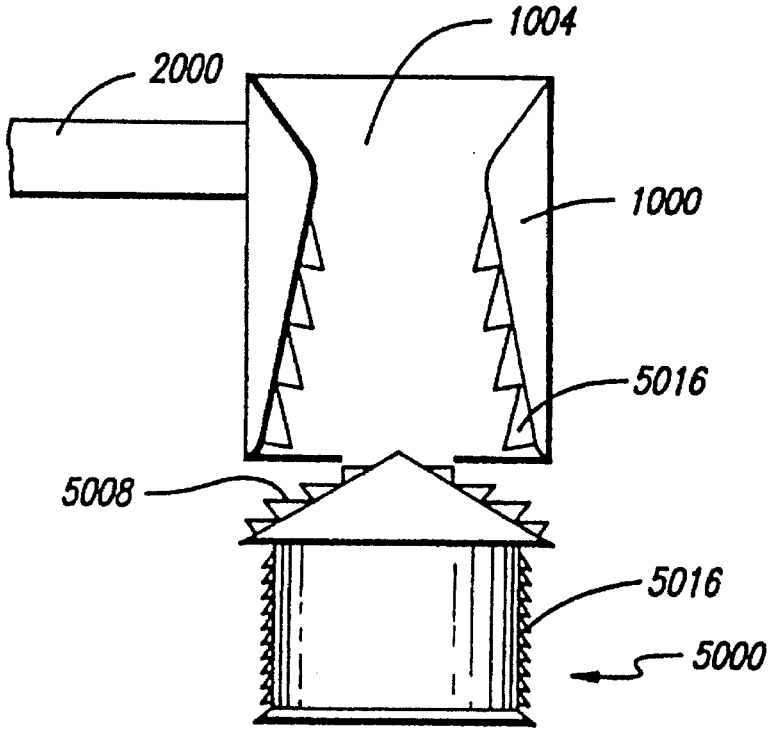

FIG. 18a
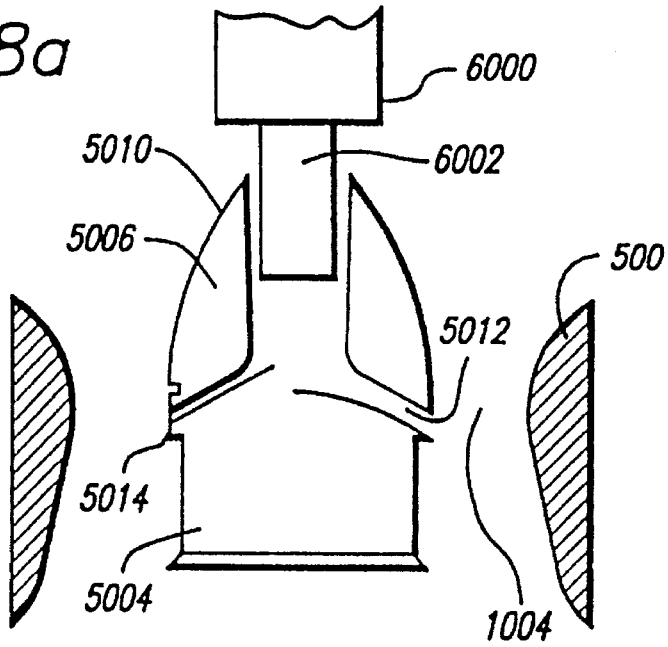
FIG. 18b
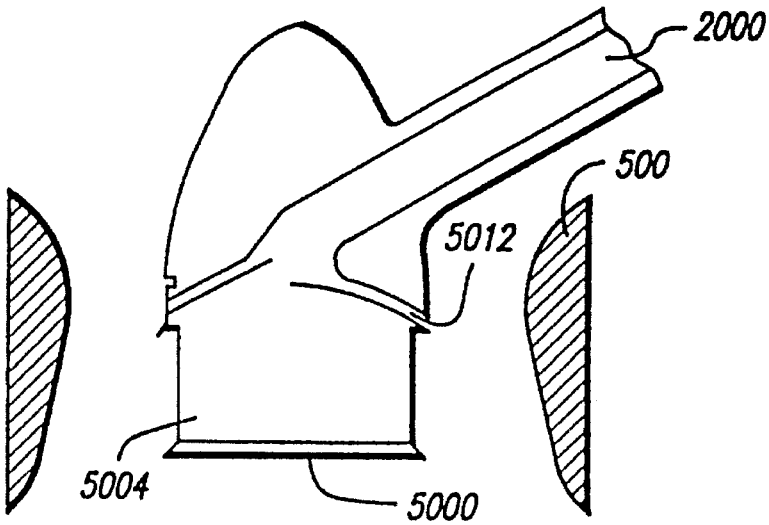
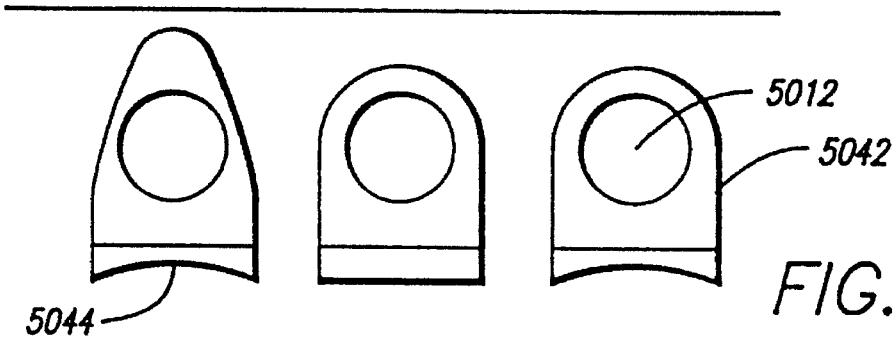
FIG. 18c

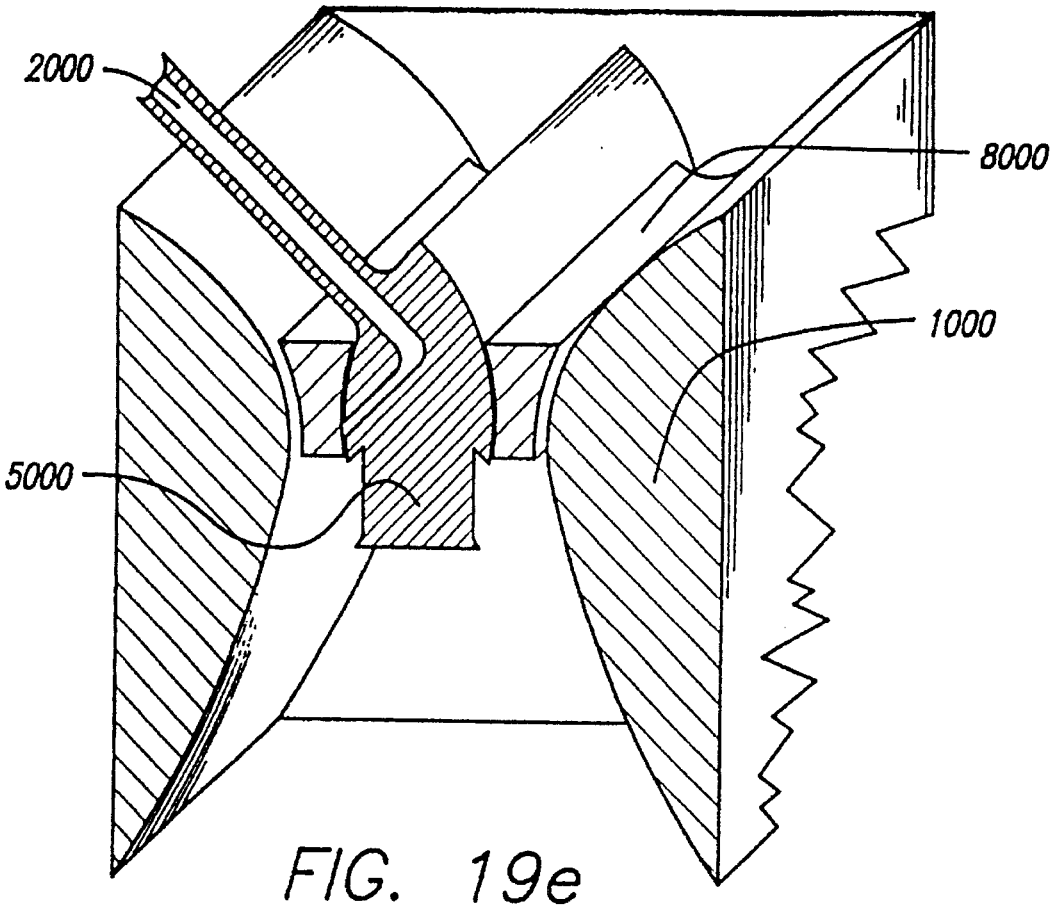
FIG. 19e
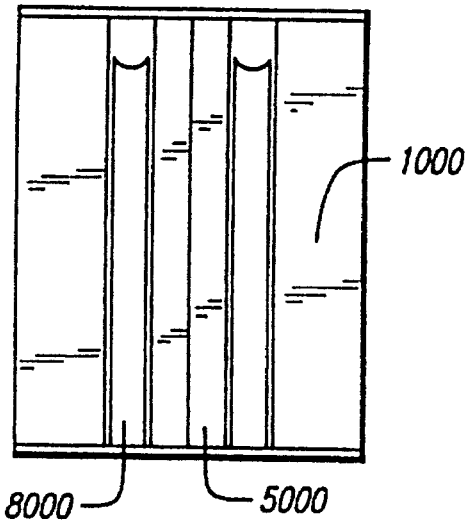
FIG. 19f
FIG. 19g
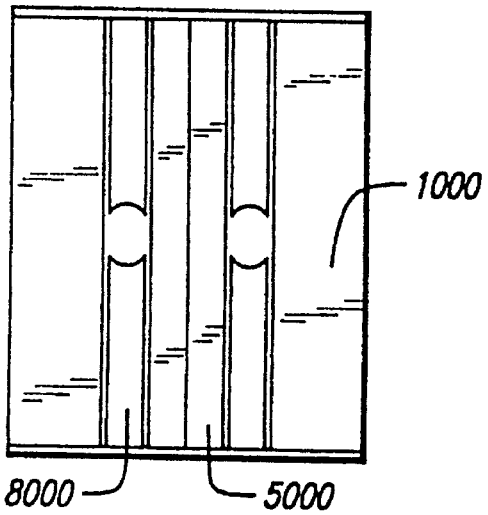

POWER VAPOR NOZZLE AND SPLASH PLATE

This is a continuation of co-pending application Ser. No. 08/166,974, filed on Dec. 14, 1993, which is a Continuation-in-Part of U.S. Ser. No. 07/917,203 filed on Jul. 17, 1992, now abandoned, which is a continuation-in-Part of U.S. Ser. No. 07/806,907 filed on Dec. 13, 1991, now abandoned in favor of CIP application Ser. No. 07/917,203. All of the foregoing are incorporated herein by reference.

BACKGROUND OF THE INVENTION

Devices which allegedly maximize fuel efficiency and minimize pollutants are many. A list of those most pertinent to the present discussion is set forth below. None of these devices are the same as the invention now presented.

U.S. Pat. No. 1,816,756 (Whatmough)
U.S. Pat. No. 1,187,826 (France)
U.S. Pat. No. 1,889,687 (Mennesson)
U.S. Pat. No. 1,895,470 (Mathieu)
U.S. Pat. No. 1,895,471 (Mathieu)
U.S. Pat. No. 1,941,658 (Bucherer)
U.S. Pat. No. 1,949,031 (Weber)
U.S. Pat. No. 1,979,918 (Walmark)
U.S. Pat. No. 2,133,033 (Messinger)
U.S. Pat. No. 2,364,987 (Lee)
U.S. Pat. No. 2,702,185 (Lavin)
U.S. Pat. No. 2,704,659 (Fuchs)
U.S. Pat. No. 2,783,983 (Benvenuti)
U.S. Pat. No. 2,899,185 (Rector)
U.S. Pat. No. 2,986,378 (Moseley)
U.S. Pat. No. 2,996,290 (Munden)
U.S. Pat. No. 3,168,599 (Marsee)
U.S. Pat. No. 3,664,648 (Seeley, Jr.)
U.S. Pat. No. 3,917,758 (Huff)
U.S. Pat. No. 4,052,489 (Frey)
U.S. Pat. No. 4,133,849 (Hecht)
U.S. Pat. No. 4,278,618 (Higashigawa)
U.S. Pat. No. 4,375,438 (McKay)
U.S. Pat. No. 4,574,760 (Jones)
U.S. Pat. No. 4,670,195 (Robson)
U.S. Pat. No. 5,053,170 (Drahos)

BRIEF DESCRIPTION OF THE DRAWINGS

FIG. A is a top view of a four-barrel carburetor.

FIG. B is a second view of FIG. A with certain embodiments of the present inventions connected thereto.

FIGS. 8*a* and 8*b* is a side sectional view of a power vapor nozzle connected directly to a fuel line.

FIG. 10 is a side diagrammatic sectional view of the scales of FIG. 9*a*.

FIG. 18*a* is a side view of a bullet-like design of a power vapor nozzle as used with a fuel injector.

FIG. 18*b* is the same view as that of FIG. 18*a* except that a fuel line is shown.

FIG. 18*c* is a detailed front view of air gas openings surrounded by frames and ledges.

FIG. 19*e* is a perspective view of a modified power vapor nozzle and sliders located in a carburetor opening.

FIGS. 19*f* and 19*g* are top views of FIG. 19*d* with varying slider configurations.

DETAILED DESCRIPTION OF THE INVENTION

FIG. A is a top view of a four-barrel carburetor having carburetor openings 500. Within each opening 500 is venturi 1000 and opening into each venturi 1000 is fuel line 2000. The term "venturi" is used to describe the entire opening defined by venturi 1000 rather than the narrowest portion of that opening. In use, fuel is fed through fuel line 2000 into venturi 1000.

Situated between two of openings 500 is an accelerator pump nozzle 3000. Accelerator pump nozzle 3000 spews out gas that enters into carburetor openings 500 and splashes against venturi 1000. The fuel line 2000 passes through the body of the carburetor and extends into opening 500 and venturi 1000.

FIG. B is a view of FIG. A with embodiments of the present invention connected thereto. On accelerator pump nozzle 3000 is a bent, somewhat triangularly shaped splash plate 4000. Mounted under the base of each venturi 1000 is power vapor nozzle 5000.

Figure 1A:
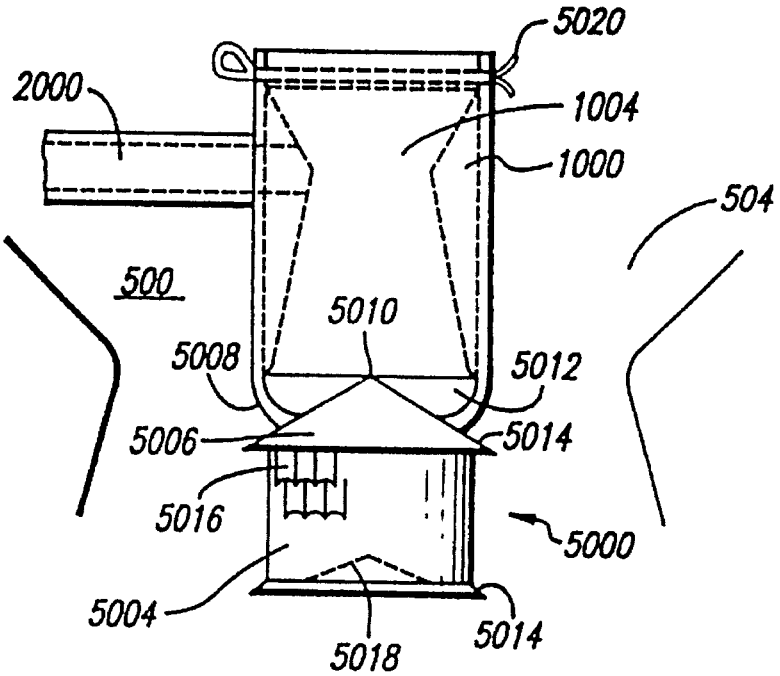
FIG. 1*a* is a diagrammatic side view of a first embodiment of the invention in which the crown is not recessed into the venturi.

FIG. 1*a* is a longitudinal side view of a first embodiment of power vapor nozzle 5000 connected below venturi 1000. Above nozzle 5000 and entering the side of venturi 1000 is fuel line 2000. The major longitudinal axis of power vapor nozzle 5000 lies in line with the major longitudinal axis of venturi 1000. The inside walls of venturi 1000 bow inwardly as seen in dotted lines but can take on other configurations some of which are disclosed herein. The bowing causes the diameter of the inside of venturi 1000 to change along its length, with point 1004, the area of least diameter, believed to be the point of maximum pressure drop. Point 504 designates the point believed to be the area of maximum pressure drop in carburetor opening 500 and is the point of smallest inside diameter in carburetor opening 500. Power vapor nozzle 5000 is comprised of a bottom tail piece 5004 which is connected to a top crown 5006. Joining side wall 5008 connects power vapor nozzle 5000 to venturi 1000 and is preferably somewhat "c" shaped, curving from crown 5006 to attach to the side walls of venturi 1000. In this curving however, joining side piece 5008 does not extend beyond the outside diameter of venturi 1000. Joining side wall 5008 is preferably wider in the area of its attachment to venturi 1000 than in the area of its attachment to crown 5006. It is, nevertheless, preferably as thin as possible while maintaining this configuration.

Taken in longitudinal cross section, tail piece 5004 is square or rectangular in shape while crown 5006 is triangular. In horizontal cross section, power vapor nozzle 5000 is generally circular. Fuel line 2000 passes through and empties gas into venturi 1000. The gas mixes with air fed into the top of venturi 1000 and the mixture passes over power vapor nozzle 5000.

Opening 5012 is located opposite of or just below the point 504 defined in carburetor opening 500. It is defined below point 1004 in venturi 1000.

Figure 1B:
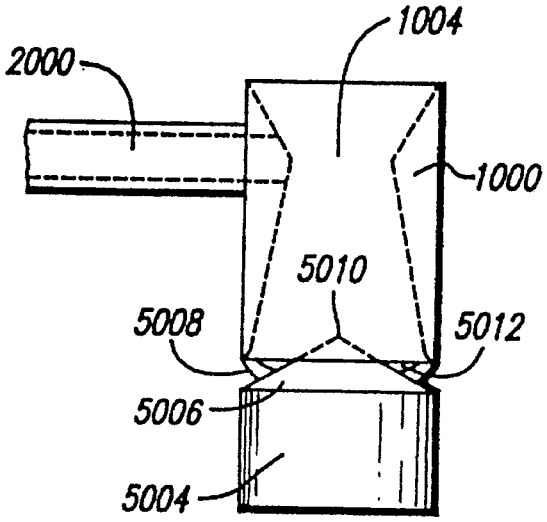
FIG. 1*b* is a view similar to that seen in FIG. 1*a* but with the crown partially recessed within the venturi.

Tip 5010 of crown 5006 may or may not be recessed within venturi 1000. FIGS. 1*a* and 1*b* disclose both situations. In FIG. 1*b*, tip 5010 is partially recessed within venturi 1000. In FIG. 1*a* it is not. In the majority of instances tip 5010 is located below the point of maximum pressure drop 1004 in venturi 1000.

The diameter of power vapor nozzle 5000 is preferably not greater than the outside diameter of venturi 1000. The width may be constant or taper, the latter situation being seen in FIGS. 2*a*, 2*c*, 2*d*, and 2*e* which are discussed in detail later herein. The diameter is smaller than the smallest diameter of carburetor opening 500. From the foregoing it should be clear that tail piece 5004 may be of a lesser diameter than that of venturi 1000.

At the bases of crown 5006 and tail piece 5004, circumferential or outside edge lips 5014 are formed causing the diameter or width of power vapor nozzle 5000 to increase at these points. That diameter is, however, still less than the smallest inside diameter of carburetor opening 500 but may be greater than the outside diameter of venturi 1000. The increase of diameter caused by lips 5014 should not be such that lips 5014 become detrimental to the functioning of the engine at high velocities and RPMs. If high velocities are not of concern, the diameter of lips 5014 could extend beyond the outside diameter of power vapor nozzle 1000. Of course, if lips 5014 become too wide, they will negatively effect the performance of the carburetor. One skilled in the art will readily appreciate the appropriate widths of lips 5014 depending upon the desired performance of the carburetor. Lips 5014 form a sharp pointed edge around power vapor nozzle 5000. In FIGS. 1*b*, 2*d*, and 2*e* lips 5014 are absent indicating that their inclusion is optional.

Around the outside of tail piece 5004 including lips 5014, and if possible, along the inside surface of joining side piece 5008, are a plurality of scales 5016 layered in overlapping fashion as shingles of a house might be. The shape of scales 5016 is quite unique. Each scale 5016 curves and bows. The curving is away from the outside surface of tail piece 5004 and upward toward venturi 1000. However the upward curvature is not so much as to encourage fuel to form pools on the scales. A magnified view of scales 5016 is seen in FIGS. 9*a* through 9*d*. These figures are discussed in greater detail later in this document.

Figure 1C:
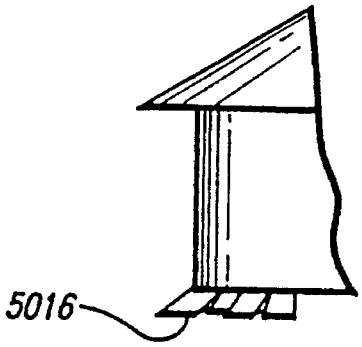
FIG. 1*c* is an enlarged view of the scales as used to make up the lip of the tail piece of the power vapor nozzle.

Smaller scales are used preferably on the portion of the tail piece 5004 below crown 5006 than on crown 5006 itself, since the velocity of air passing over crown 5006 is greater. FIG. 1*c* shows the use of scales 5016 on or for lips 5014 at the base of tail piece 5004.

Scales 5016 are used preferably on the tail pieces 5004 and side walls 5008 of all embodiments herein. They may also be used on the inside surface of venturi 1000 as shown in FIG. 10. Scales 5016 are used to keep fuel from adhering in sheets to the surfaces of tail piece 5004 and venturi 1000 by breaking up any fuel which lands thereon and directing the fuel back into the main air flow. Thus, scales 5016 facilitate the fuel being readily mixed with air passing through venturi 1000 and over and around tail piece 5004.

The underside 5018 of the base of tail piece 5004 can be flat or convex. The latter configuration is seen in dashed lines in FIG. 1*a*. It is not as important that underside 5018 be configured with scales 5016 but if it is, the scales would be as described above except that they would not curve toward venturi 1000.

Venturi 1000 is open so that air passing into carburetor opening 500 also passes into venturi 1000 and then out opening 5012. If it is desired to manufacture tail piece 5004 separately from venturi 1000, as suggested earlier, joining side piece 5008 could extend from tail piece 5004 and attach to venturi 1000 in known ways. Such attachment could be by a sleeve. In FIG. 1*a*, a circumferential sleeve is used and extends around the outside of venturi 1000 and beyond the upper open end of venturi 1000. In such extension it is retained by pin 5020. Joining side wall 5008 forms a part of the sleeve, curving in from the outside of venturi 1000 to power vapor nozzle 5000. While joining side walls 5008 have been described as "c" in shape they instead could merely be straight, extending directly down from the outside edge of venturi 1000 to some point on crown 5006.

Another means of attachment is for joining side walls 5008 to fit within and be biased against the inside diameter of venturi 1000. Still, these walls would need to be securely affixed to the inside of venturi 1000. This could be accomplished by peening, or original manufacture. Or a pin could be passed through the longitudinal center of power vapor nozzle 5000 and venturi 1000. The pin would be secured by a crossbar lying atop venturi 1000 and transverse to the opening defined in venturi 1000. It is desirable that whatever means of attachment is used, that it interfere as little as possible with the flow of air and fuel through venturi 1000. A minimal number of joining side piece(s) 5008 are used to secure power vapor nozzle 5000 to venturi 1000. Side piece(s) 5008 must be of a size and shape that obstructs as little as possible opening 5012 defined between crown 5006 and venturi 1000.

The operation of the embodiment just described is as follows. Air enters venturi 1000 and mixes with gas flowing out of fuel line 2000. To the extent that some of the fuel from fuel line 2000 splashes on the inside surface of venturi 1000, it will at opening 5012, be again forced to mix with the air passing through opening 5012. If any gas starts to pool on tail piece 5004, the shaping of crown 5006, the inclusion of lip 5014 and scales 5016 will minimize or prevent the fuel from forming a sheet or pools of fuel on power vapor nozzle 5000 and will, instead, force the fuel to mix with the air passing through opening 5012. Thus, the homogenization of the fuel with the air will be significantly enhanced. This will result in better usage of fuel and less pollutants.

While the forgoing embodiments and those that follow are described in relationship to their use with gas and air mixtures, mixtures of other liquids and fluids are contemplated. Further, while a fuel line is often described herein, the device is equally well used with fuel injection devices.

Figure 2C:
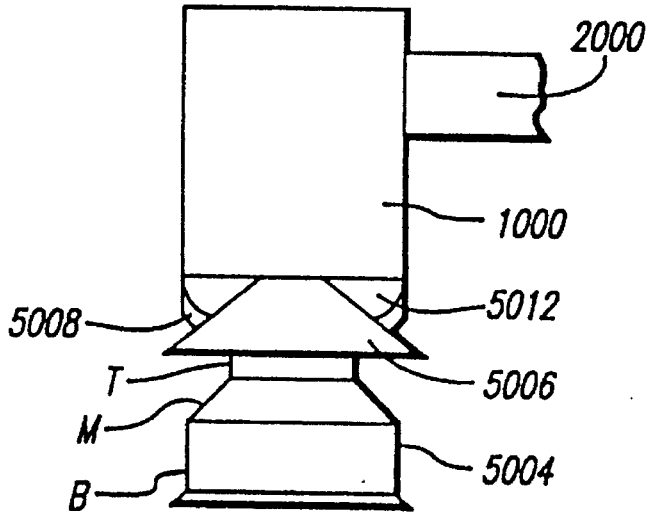
FIGS. 2*c*, 2*d*, and 2*e* are side views of modified tail pieces of the power vapor nozzle.
Figure 2D:
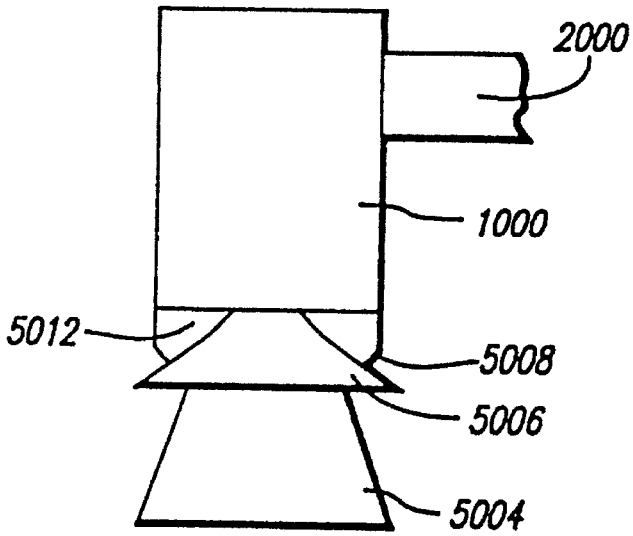
Figure 2E:
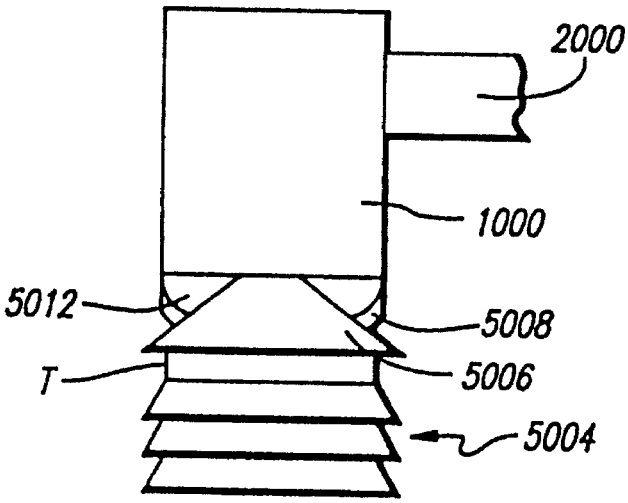
Figure 2A:
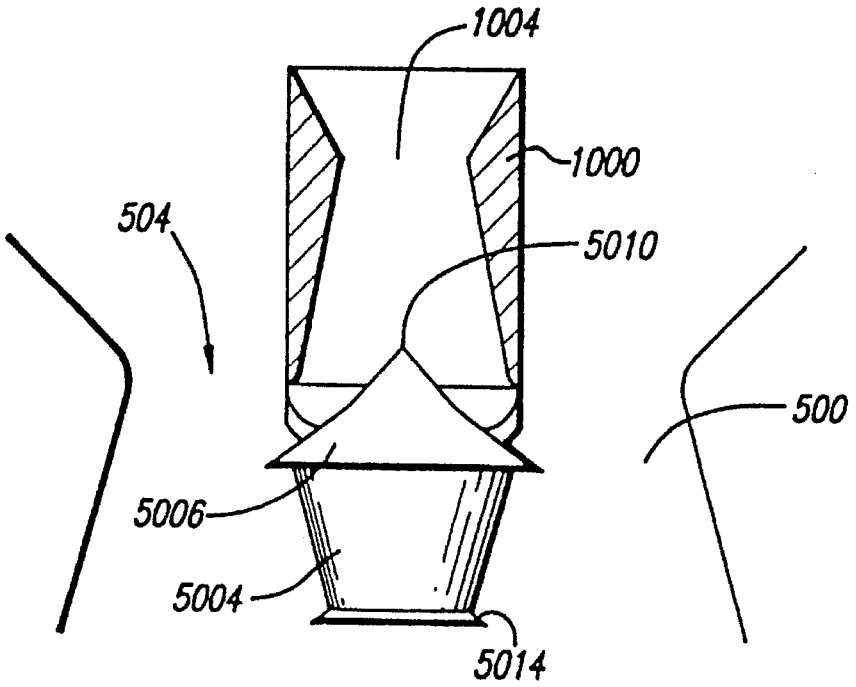
FIGS. 2*a* and 2*b* are side and side sectional views respectively, showing modifications of the power vapor nozzle of FIGS. 1*a* and 1*b*.
Figure 2B:
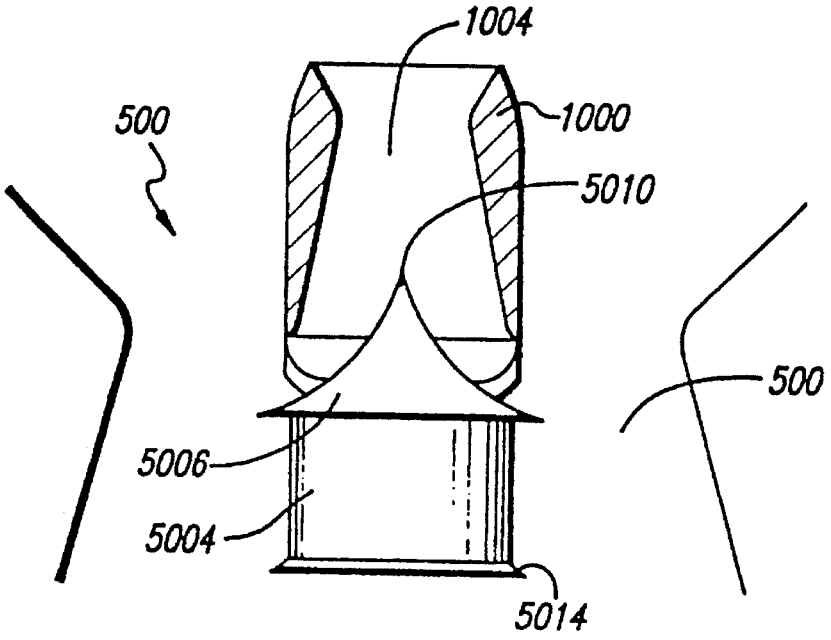

FIGS. 2*a* and 2*b* are modifications of power vapor nozzle 5000. In FIG. 2*a*, the tail piece 5004 has a changing diameter so that its base is narrower than is that portion which is below lip 5014 formed on crown 5006. Crown 5006 no longer has sides which are straight as they extend from lip 5014 to tip 5010. Instead, they curve toward the base of tail piece 5004 except as they join tip 5010. There, they are concave. This formation gives crown 5006 a somewhat dome-like configuration to form an ogee. In FIG. 2*b*, the sides of crown 5006 curve upwardly toward the venturi 1000 between lip 5014 and tip 5010.

FIGS. 2*c* 2*d*, and 2*e* emphasize modifications of tail piece 5004. In FIG. 2*c*, while tail piece 5004 initially is of a first constant diameter for a set distance, it then abruptly begins to angle outwardly to a second diameter wider than the first. Thus the tail piece has a top section (T) with parallel sides, the top section (T) depending from the crown 5006; a middle section (M) with an increasing diameter which widens from its joinder to the top section (T); and a bottom section (B) with a constant diametr equal to the widest diameter of middle section (M) from which it depends. Lip 5014 surrounds the bottom of section (B).

In FIG. 2*d*, tail piece 5004 gradually increases in diameter from its point of connection to crown 5006 to its base. This configuration is opposite to that seen in FIG. 2*a*. Finally, in FIG. 2*e*, tail piece 5004 has several tiers of flared diameter. Its top section (T) which joins crown 5006 is of constant diameter. This top section then connects to a first flared section. The second flared section connects to a third flared section. The number of flared sections and their ultimate diameters will depend on desire engine performance.

Figure 3A:
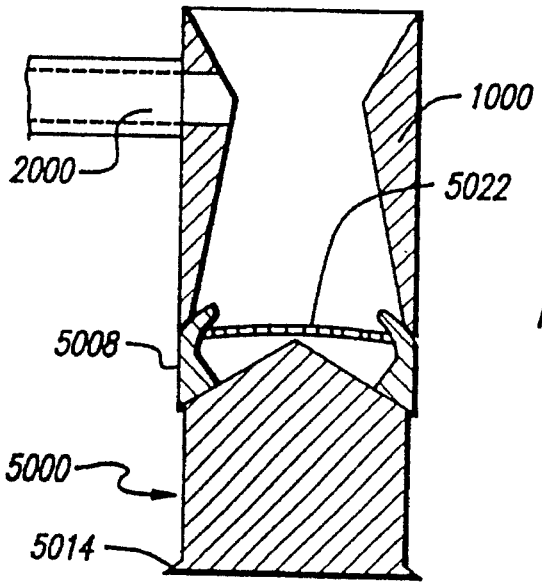
FIG. 3*a* is a side sectional view of a venturi with an internally protruding ring.

FIG. 3*a* discloses a venturi 1000 which has been retrofitted with a power vapor nozzle 5000. Circumferential ring 5022 attaches to power vapor nozzle 5000 at joining side pieces 5008 and fits snugly inside the base of venturi 1000. In cross-section, as seen in FIG. 3*a*, circumferential ring 5022 has a hook-like appearance curving inwardly and toward the tip of crown 5010 to form a curved knife-like edge. In this embodiment, ring 5022 is not mandatory, but is introduced as a means of ensuring that gas that might land on the inside walls of venturi 1000 is forced back into the main air flow passing through venturi 1000 by the downward curving edge of joining ring 5022. Side walls 5008 still extend from a crown 5006 to now ring 5022 keeping power vapor nozzle 5000 spaced from venturi 1000 and leaving open opening 5012. Circumferential ring 5022 may supplement or replace any scaling placed on the inside surface of venturi 1000. Either ring 5022 or side walls 5008 if attached to the inside surface of venturi 1000 are manufactured therein, peened in, or otherwise securely affixed.

Figure 3B:
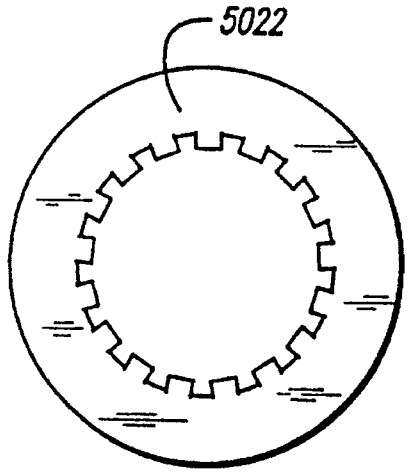
FIG. 3*b* is a top view of the ring of FIG. 3*a*.
Figure 3C:
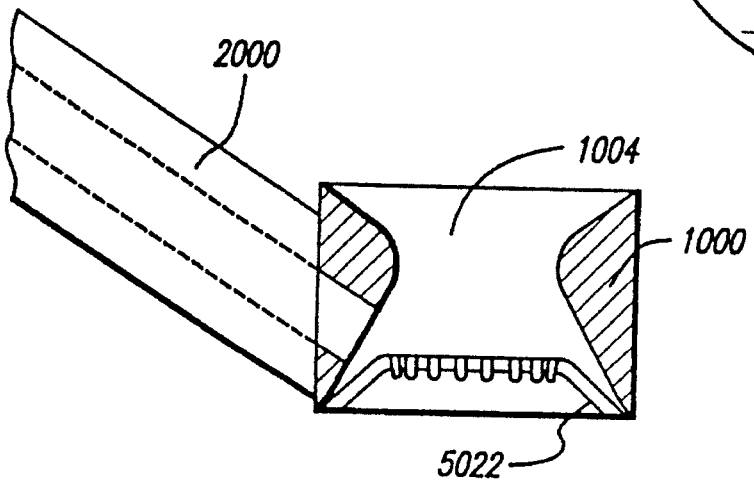
FIG. 3*c* is a side view of the ring of FIG. 3*a*.

FIG. 3*b* is a top view of circumferential ring 5022 where serrations are present at its knife-like edge. FIG. 3*c* is a side view of a venturi 1000 with serrated circumferential ring 5022 inserted therein. However, power vapor nozzle 5000 is no longer present. The serrations in both FIGS. 3*b* and 3*c* are formed to make stepped levels.

In FIGS. 3*a* and 3*c*, fuel line 2000 extends into venturi 1000 below point 1004 where the inside diameter of venturi 1000 is the smallest. Circumferential ring 5022 rests just below feed line 2000 causing the internal diameter of venturi 1000 to narrow but not more than at 1004.

Figure 4:
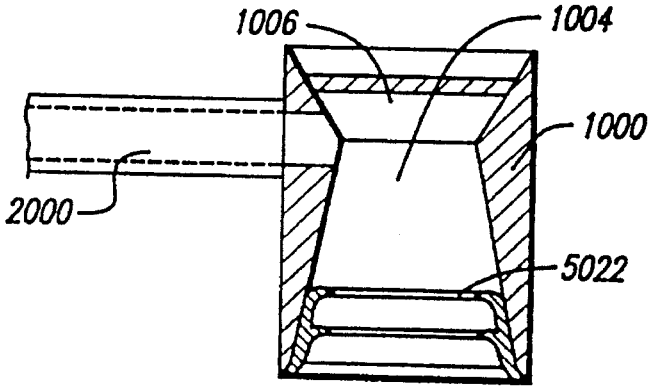
FIG. 4 is a side sectional view of a venturi with stacked rings of FIG. 3*a*.

In FIG. 4, a modified circumferential ring 5022 is shown. Here, at least three layers of rings 5022 having stepped serrated knife-like edges are present. The bottom is placed quite close to the base of venturi 1000 and a distance from the base of fuel line 2000 and the narrowing of the inner walls of the venturi. Also shown in FIG. 4 is venturi bridge 1006 which rests above fuel line 2000 and is well known in the art. Venturi bridge 1006 is in cross section "C" shaped. This causes it to have a rounded top, an open base, and a hollow interior. In FIG. 4, fuel line 2000 enters venturi 1000 near its top, and therefore, it is possible to add a number of rows of rings with stepped serrated knife-like edges 5022.

Figure 5A:
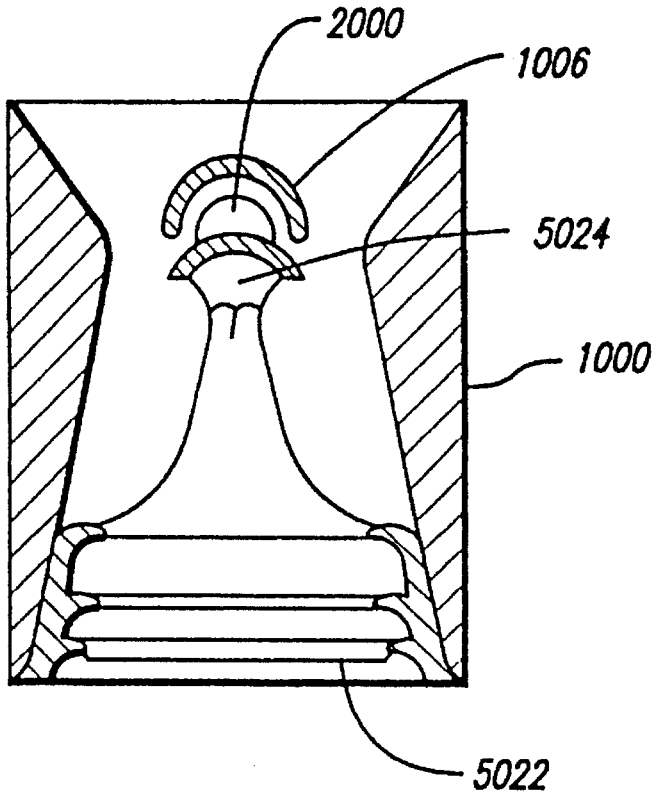
FIGS. 5*a* and 5*b* are side sectional views of a venturi with a top fuel directional bar as combined with the rings of FIG. 3*a*.
Figure 5B:
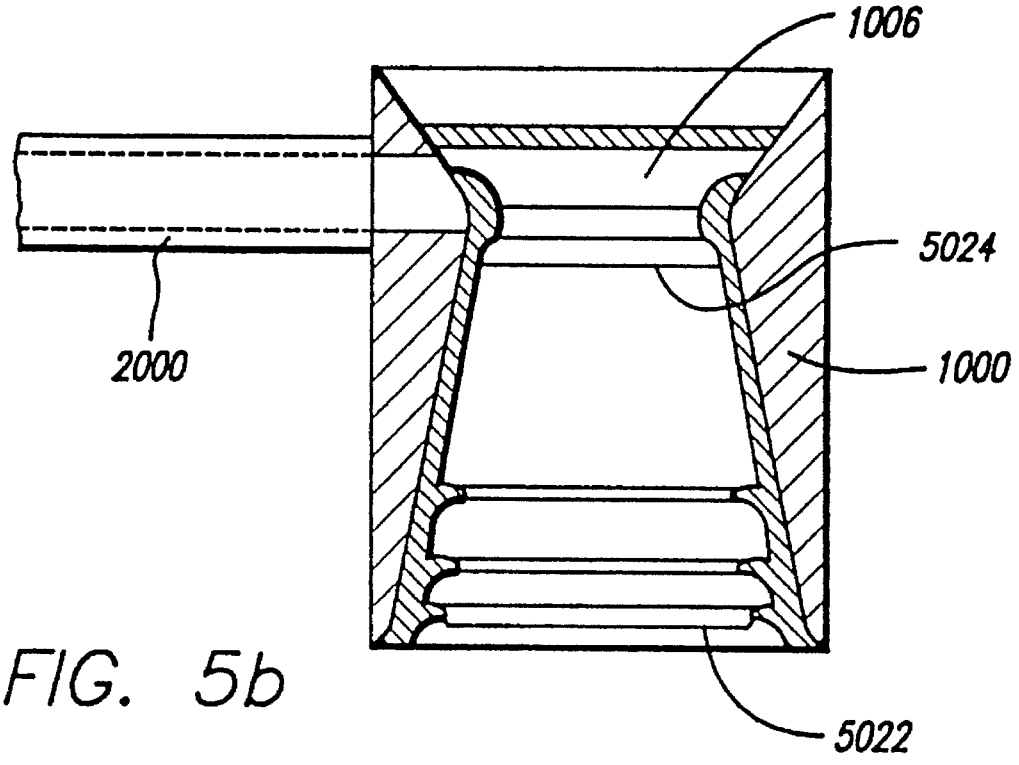

FIG. 5*a* is a side sectional view of a venturi 1000 with a bridge 1006. The view is taken parallel to lines of rings in venturi 1000 and traversing bridge 1006. FIG. 5*b* is a side sectional view of FIG. 5*a* traversing the line of rings and parallel to bridge 1006. In FIGS. 5*a* and 5*b*, a first upper curved bar 5024 is seen extending across the upper diameter of venturi 2001, just below and parallel to bridge 1006 and fuel line 2000. The bar may be c-shaped with the middle portion of the curve being directly below bridge 1006. Or bar 5024 may be curved on opposing sides of a straight stem as seen in FIG. 5*a*. The curved portion still lies below bridge 1006. The formation of bar 5024 is such as to cause fuel to ride over its top and down its sides without adhering in sheets or pools to bar 5024. Therefore, the sides of bar 5024 will define a plurality of rings 5022. This causes the fuel ab initio to be introduced into the air passing through the venturi 1000. Bar 5024 may be formed as a part of circumferential ring 5022, as a part of venturi 1000, or as a separate piece.

Below upper curved bar 5024 are the annulus of rings with knife like edges having stepped protrusions 5022. These extend from the sides of the inside of venturi 1000. Fuel that may run along the walls of venturi 1000 is instead directed into the air flow by these protrusions. Of course, rings 5022 could be omitted altogether if the inside surface of venturi 1000 is covered with scales 5016 described earlier herein or otherwise treated to prevent fuel from adhering to the inside of venturi 1000 and to direct the fuel into the air flow.

Figure 6A:
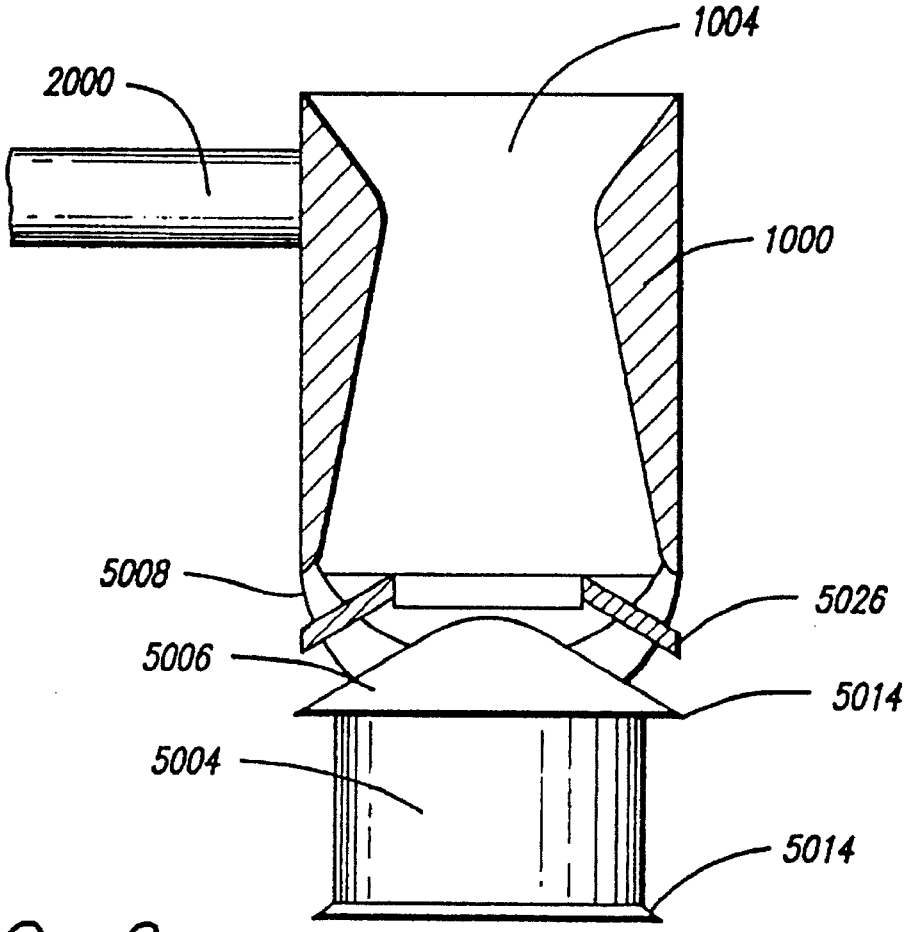
FIG. 6*a* is a side sectional view of a power vapor nozzle with a ring of vaporizing wings inserted between the power vapor nozzle and the venturi.
Figure 6B:
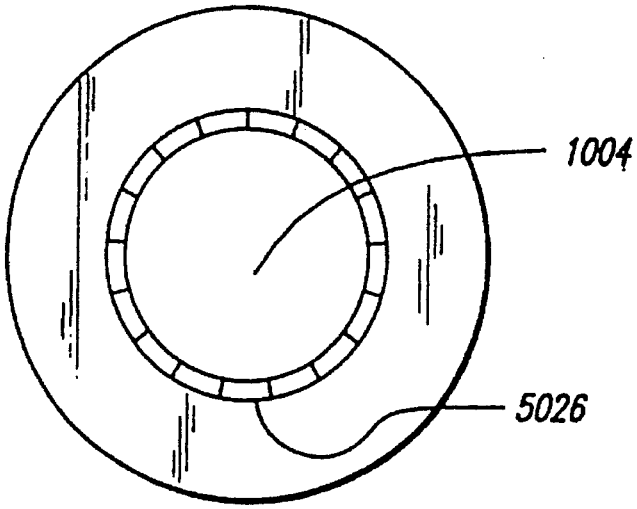
FIG. 6*b* is a top view of the ring of vaporizing wings.

FIG. 6*a* is a power vapor nozzle 5000 with a plurality of overlapping wings 5026 joined together in a circular band at their outside ends. A top view of the band of wings 5026 is shown in FIG. 6*b*. The band connects to the inside surface of joining side walls 5008 thereby interrupting opening 5012 along a single horizontal line. Overlapping wings 5026 protrude into and angle toward the top and center of venturi 1000 generally in parallel with but spaced from crown 5006. Instead, a simple solid band not broken into overlapping wings may be used. The band then would angle upwardly toward the top and center of venturi 1000.

Figure 7A:
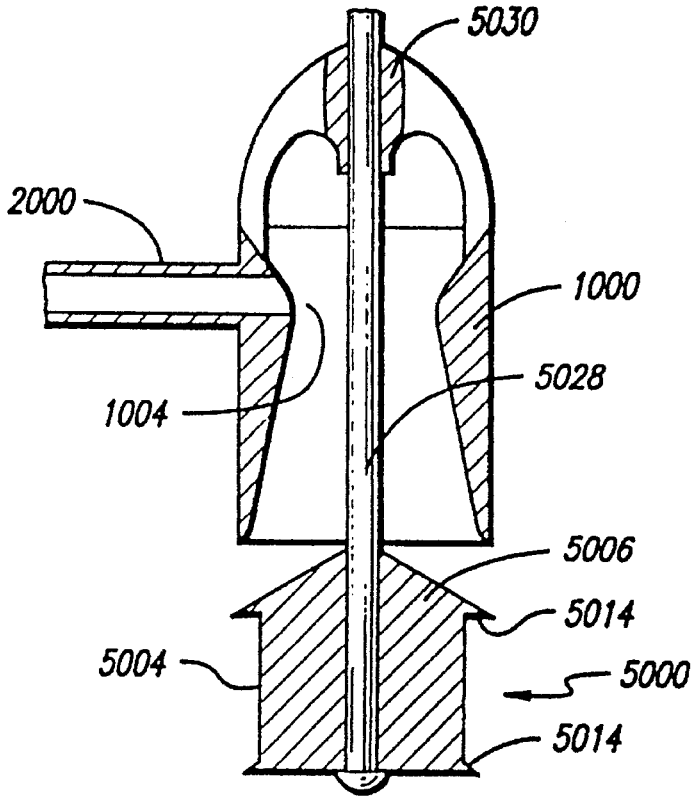
FIGS. 7*a* and 7*b* are side sectional views of a power vapor nozzle connected to a central shaft.

In FIG. 7*a*, fuel line 2000 extends and pours directly into venturi 1000 which is centrally connected by a center shaft 5028 to power vapor nozzle 5000. Side piece(s) 5008 are therefore omitted. Power vapor nozzle 5000 is understood to preferably include scales 5016 and lips 5014. Center shaft 5028 extends along the central longitudinal axis of venturi 1000. It is mounted in venturi divider cap 5030 at one end and pierces tip 5010 and passes into and through tail piece 5004 at the other end. Cap 5030 is shown transversing the top of venturi 1000. It is generally flat and triangular in shape causing it to bisect the top opening defined in venturi 1000. Its base defines a lower case "n" written in script with shaft 5028 passing between the two humps that form the "n". Cap 5030 is meant to only minimally effect air flow into venturi 1000. Therefore, it divides the top opening of venturi 1000 with as little material as possible. Power vapor nozzle 5000 is slidably mounted on shaft 5028 so that the size of opening 5012 may be adjusted to meet engine demands. This means that its position will change with changes in the air flow through carburetor opening 500. Means of attending to this are well known in the art.

Figure 7B:
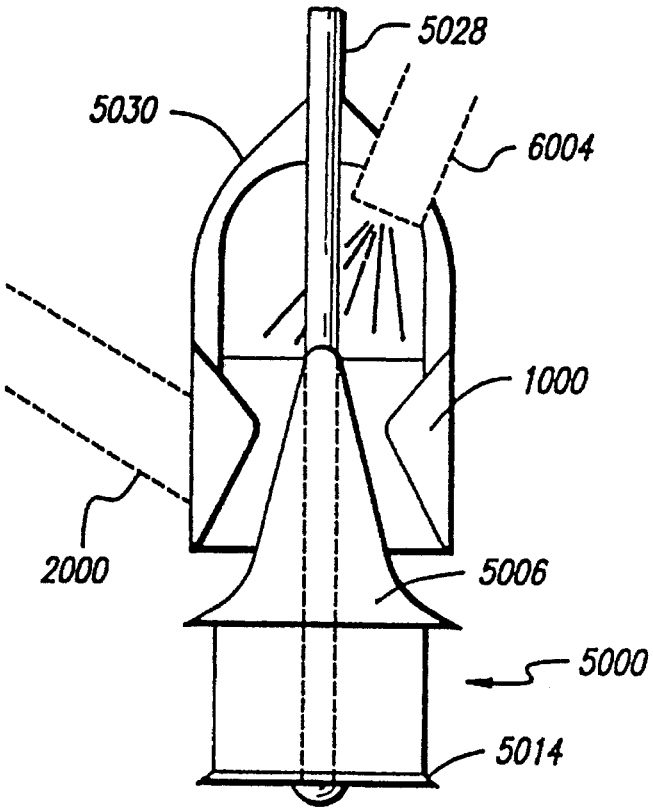

FIG. 7*b* is identical to FIG. 7*a* except crown 5006 extends into venturi 1000 beyond point 1004. FIG. 7*b* emphasizes again that the embodiments may be used with fuel injectors 6000 or fuel lines 2000. The embodiment in FIG. 7*b* will provide a different vacuum signal than that of FIG. 7*a*. This is due to the placement of the crown in venturi 1000.

In FIGS. 8*a* and 8*b*, power vapor nozzle 5000 is connected directly to fuel line 2000 by means of joining side walls 5008. Again opening 5012 is present, here between crown 5006 and the end of fuel line 2000. It is situated in area 504 of carburetor opening 500. Preferably power vapor nozzle 5000 is covered with scales 5016. Thus in these embodiments venturi 1000 has been dispensed with altogether.

Figure 9A:
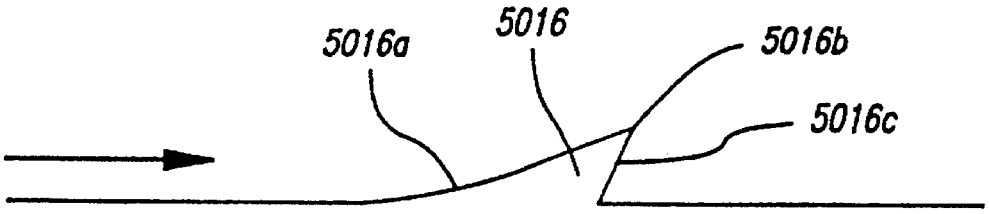
FIGS. 9*a* through 9*d* present detailed diagramatic views of the scales used on the power vapor nozzle and in the venturi.
Figure 9B:
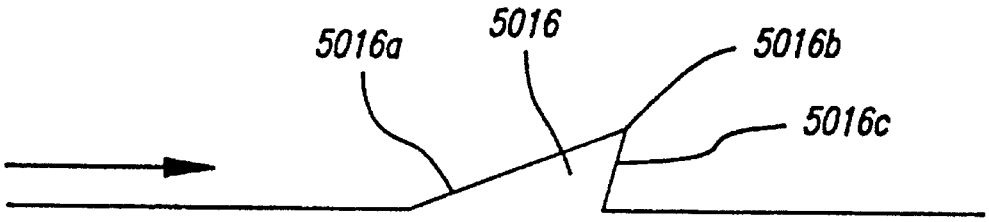
Figure 9C:
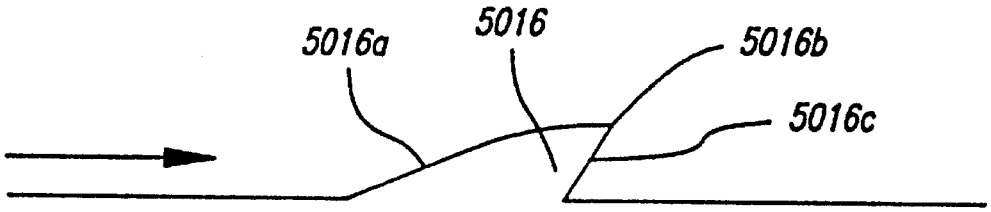
Figure 20A:
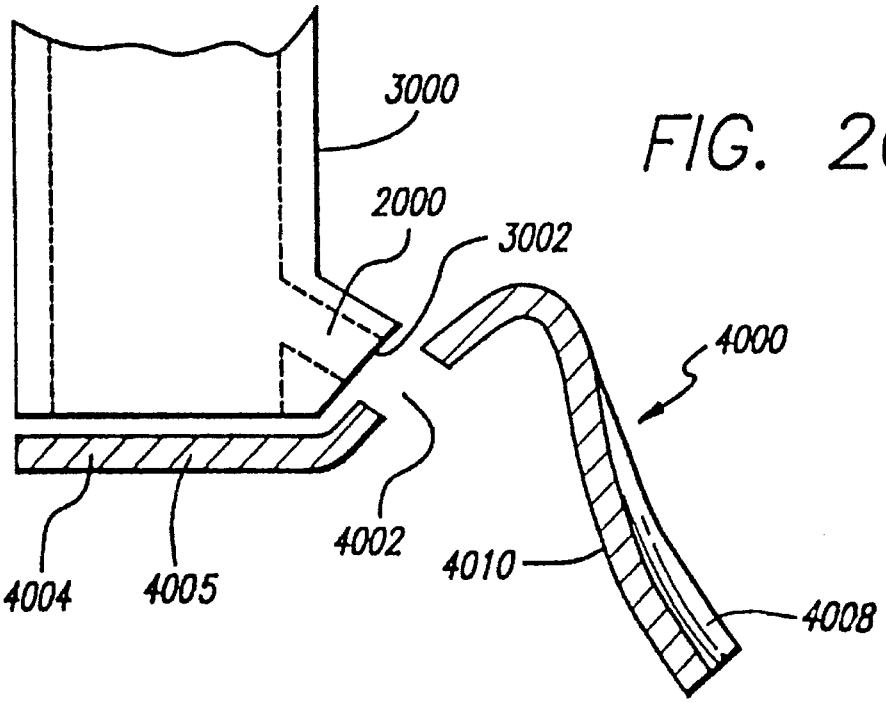
FIG. 20*a* is a side view of a splash plate and accelerator pump.
Figure 20B:
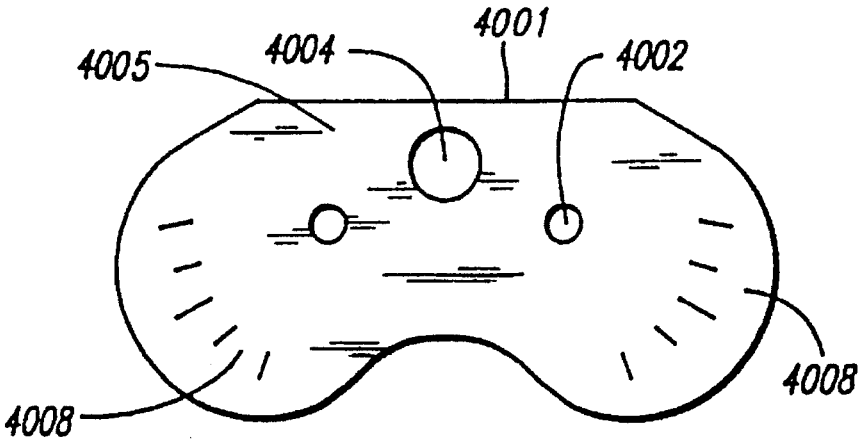
FIG. 20*b* is a top view of the splash plate of FIG. 20*a*.
Figure 20C:
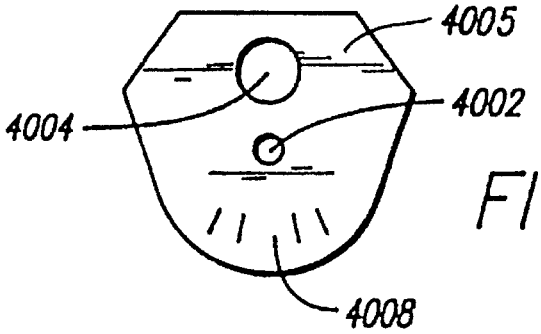
FIG. 20*c* is a an end view of the tip of the splash plate.
Figure 20D:
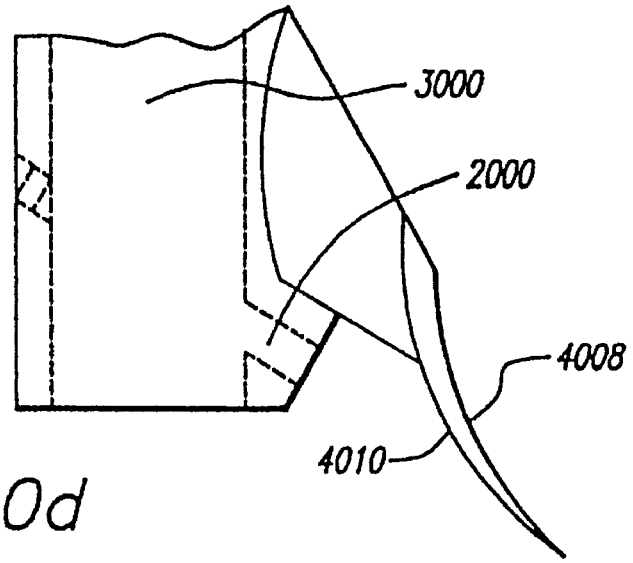
FIG. 20*d* is a side view of a an accelerator pump with the tip of splash plate connected thereto.
Figure 20E:
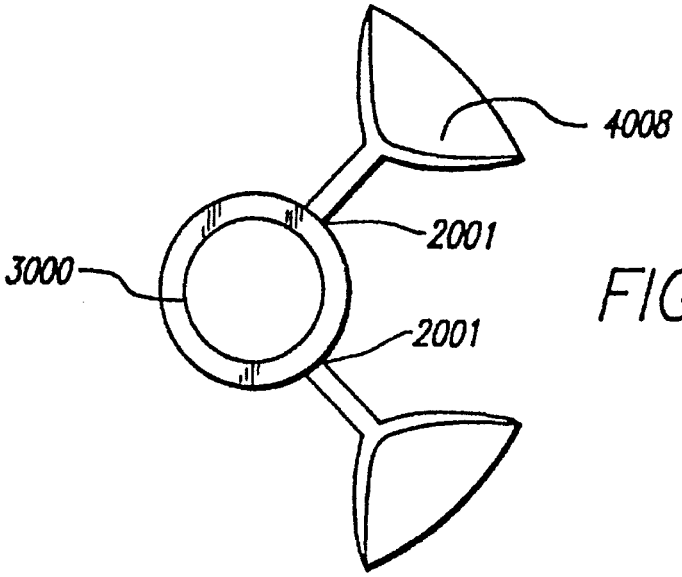
FIG. 20*e* is a top view of an embodiment similar to FIG. 20*d*.
Figure 20F:
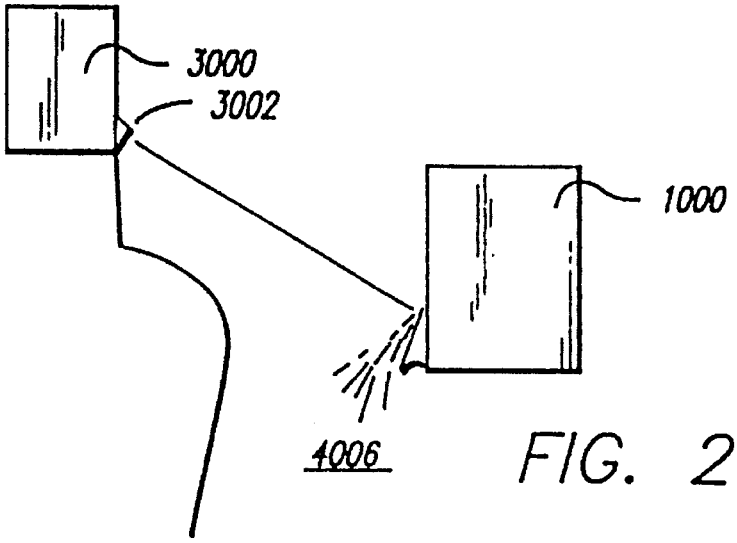
FIG. 20*f* is a side view of an accelerator pump and a venturi with a triangular splash plate on the venturi.
Figure 20G:
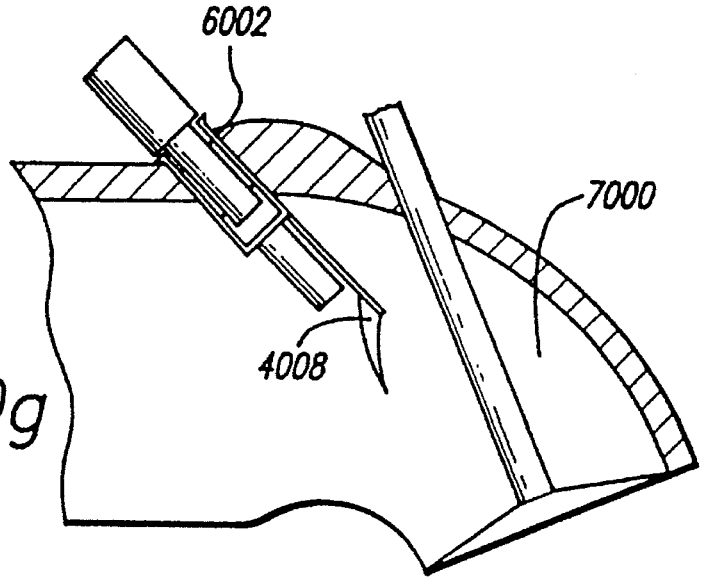
FIGS. 20*g* and 20*j* are side diagrammatic view of splash tips located in an intake port.
Figure 20H:
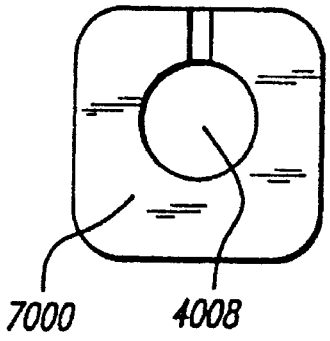
FIGS. 20*h*, 20*i*, and 20*k* are rear views of splash tips of FIGS. 20*g* and 20*j*.
Figure 20I:
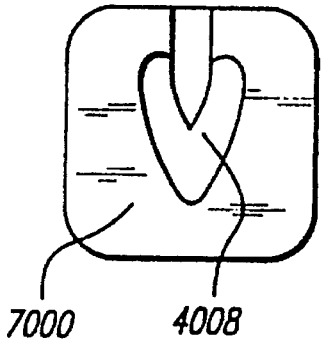
Figure 20K:
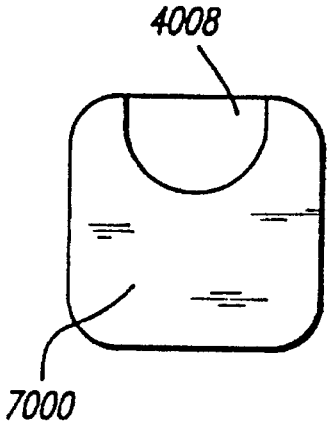
Figure 20J:
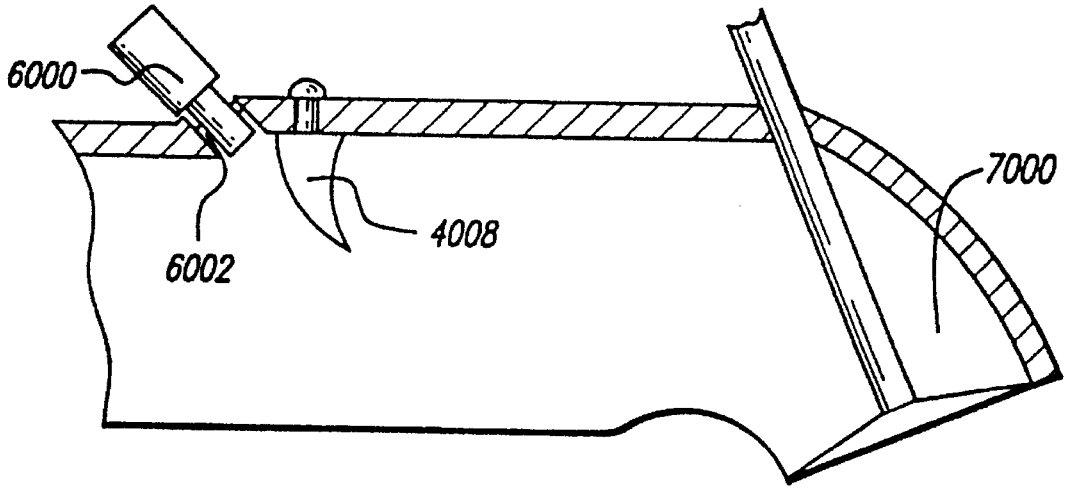
Figures 1, 20L:
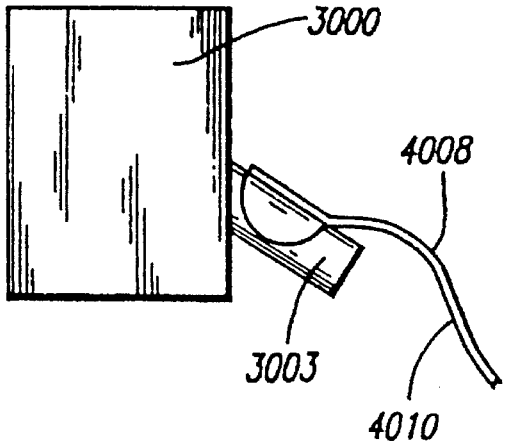
FIGS. 20*l*-1 and 20*l*-2 are side views of an accelerator pump with a splash plate tip.

In FIGS. 9*a* through 9*d*, scales 5016 first described with respect to FIG. 1, are shown. These scales are used at least on power vapor nozzle 5000 and could as well be used on the inside surface of venturi 1000. In side view, scales 5016 are somewhat triangular in form with their apexes being located off-center of the center of the triangle's base. This causes each triangle to have one side that is longer than the other. The longer side 5016*a* begins as a flat surface and then reaches toward apex 5016*b* in a curved or angled manner. Shorter side 5016*c*, which descends from apex 5016*b* to the base of the triangle, is a generally straight line, although the line may curve. Each figure includes an arrow to denote the manner in which the scale 5016 should be mounted so that the fuel air mixture passes over side 5016*a*. In FIG. 9*a*, a diagrammatic side view of a single scale is shown. Longer side 5016*a* curves upwardly from an initially straight almost horizontal portion. Shorter side 5016*c* descends to the base and may do so in a curve or straight line. It forms with the base an angle of 90 degrees or less. If line 5016*a* is curved, arcing upwardly toward apex 5016*b*, it will give to the scale of FIG. 9*a* a bowed configuration with shorter side 5016*c* defining the underside of the bow portion. In FIG. 9*b*, the longer side of scale 5016 is seen to angle upwardly without arcing. In FIG. 9*c*, while the scale still ultimately rises, its longer side 5016*a* curves downwardly and the shorter side 5016*c* can mimic to some degree that curving causing the scale to be generally convex in appearance. The shorter side 5016*c* may also be straight.

Figure 9D:
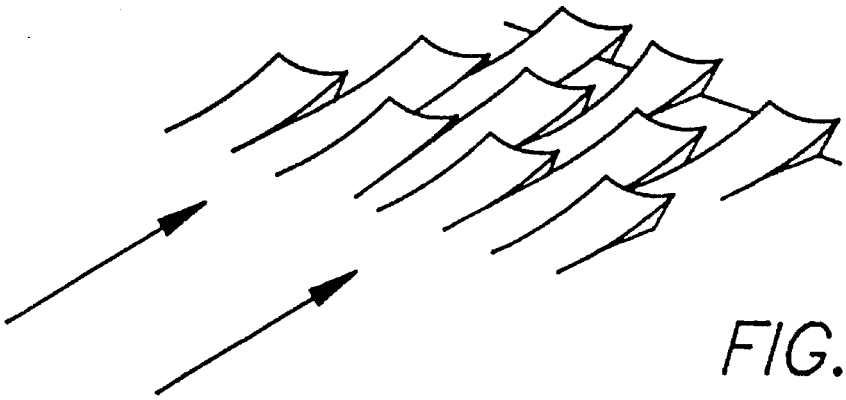

FIG. 9*d* illustrates the layering of scales 5016. It can be seen in that figure how each row of scales overlaps another row and how the scales are placed in a shingle-like configuration. The scales in FIG. 9*d* are those of FIG. 9*a* and so they are seen to be generally curved in configuration. Their tips 5016*e* are squared and bent such that the scale 5016 bends up toward itself at its end. The scale of FIG. 9*a* is the preferred embodiment although circumstances that one skilled in the art would readily recognize, might require the other configurations to be used.

Scales 5016 of FIG. 9*a* are shown in use in FIG. 10. Note should be made that scales 5016 are included in venturi 1000, below the fuel line 2000 and the point of least diameter 1004 as well as on power vapor nozzle 5000.

Figure 11:
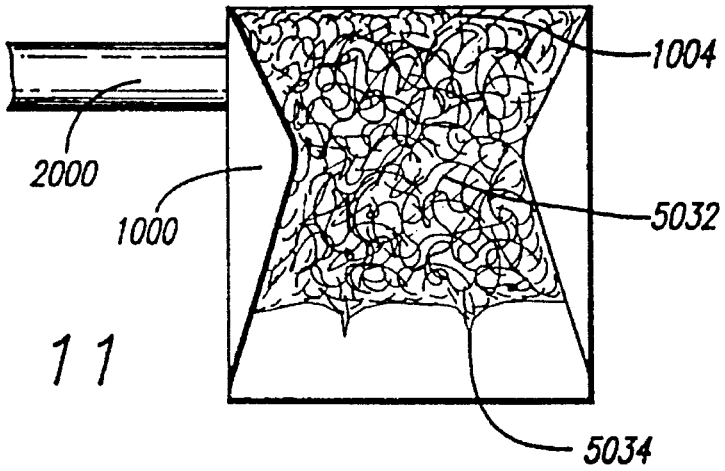
FIG. 11 is a side sectional view of a filtering means placed within a venturi.

FIG. 11 presents another sort of insert 5032 which varies significantly from the scales 5016 and serrations 5022 earlier described. This insert 5032 fills venturi 1000 in that it stretches from side to side inside of venturi 1000 and from the top of the fuel line 2000 where it opens into venturi 1000 to below the narrowest diameter point 1004. Its top is generally in line with the top of fuel line 2000. Its base defines a plurality of points 5034. While the previous inserts were created of plastic, rubber, or metal pieces, insert 5032 is created by numerous strands or fibers which make it porous. It acts then like a filtering element. The fibers of insert 5032 extend in a predominantly horizontal direction. A product which may be used in this embodiment is manufactured by 3M under the trade name SCOTCH-BRITE BRAND. The coarse, most porous variety of this product is the preferred material to use. The fuel-air mixture passes through insert 5032, streaming over and between the horizontally angled fibers and out air opening 5012.

Figure 12A:
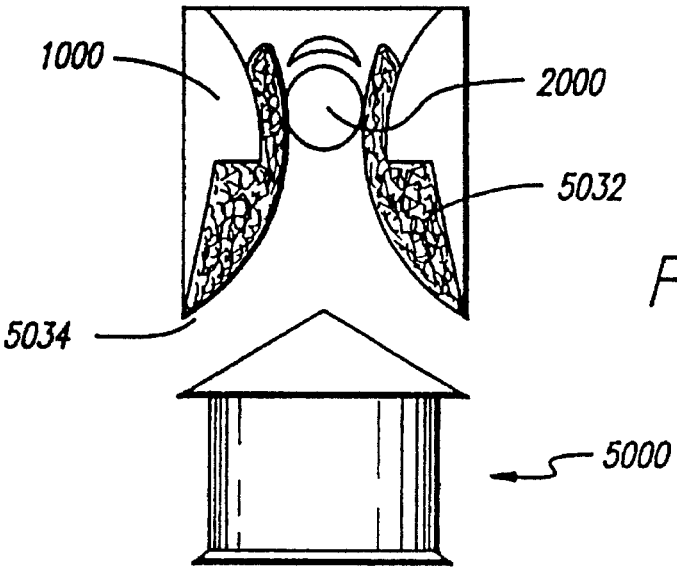
FIGS. 12*a* and 12*b* are further embodiments of the filter used in FIG. 11.
Figure 12B:
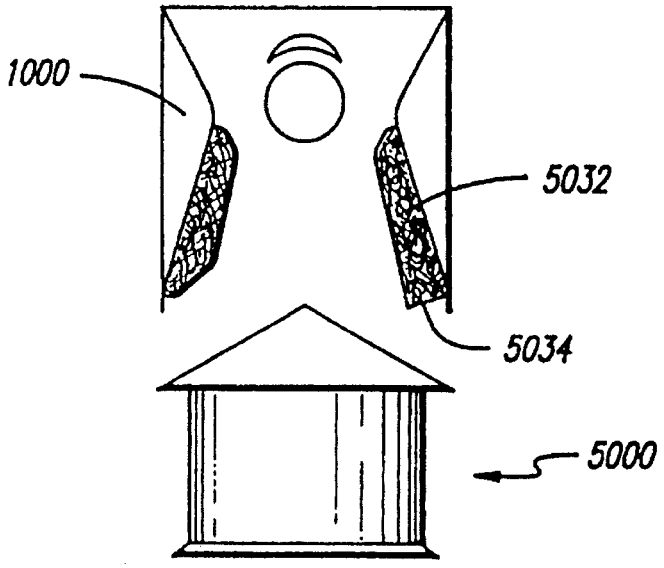

Further embodiments making use of the fibrous insert 5032 presented in FIG. 11 are seen in FIGS. 12*a* and 12*b*. In FIG. 12*a*, the wall of venturi 5000 narrows abruptly after point 1004, thus forming a shoulder at that point. Insert 5032 no longer stretches across the inside of venturi 5000, but lies against its inside surface, and thickens at the point where the inside diameter of venturi 1000 abruptly widens. Thus insert 5032 causes the inside diameter of venturi 5000 in FIG. 12*a* to take on the configuration of prior embodiments in the sense that it bows smoothly inwardly. With insert 5032, the effective internal configuration of venturi 5000 is a smooth curving taper to and then away from a narrowest diameter point 1004. Again in FIG. 12*a*, the base of insert 5032 includes points 5034.

In FIG. 12*b*, the situation of FIG. 12*a* is altered only slightly. The walls of venturi 5000 narrow somewhat less abruptly than in FIG. 12*a*. Insert 5032, however, softens this narrowing to change the effective inside configuration of venturi 5000. Again, points 5034 are present at the bottom end of insert 5032. Use of insert 5032 as shown in the foregoing embodiments, keeps the fuel from forming as sheets on the inside walls of venturi 1000 and thereby forces it to mix and homogenize better with the air passing through venturi 1000. End points 5034 assist in achieving this goal. Further, the use of inserts such as used in FIGS. 12*a* and 12*b* also controls the inside diameter of venturi 5000. Insert 5032 may be used in lieu of or in conjunction with scales 5016, inside knurling and the like which would be placed on the inside surface of venturi 1000.

Figure 13A:
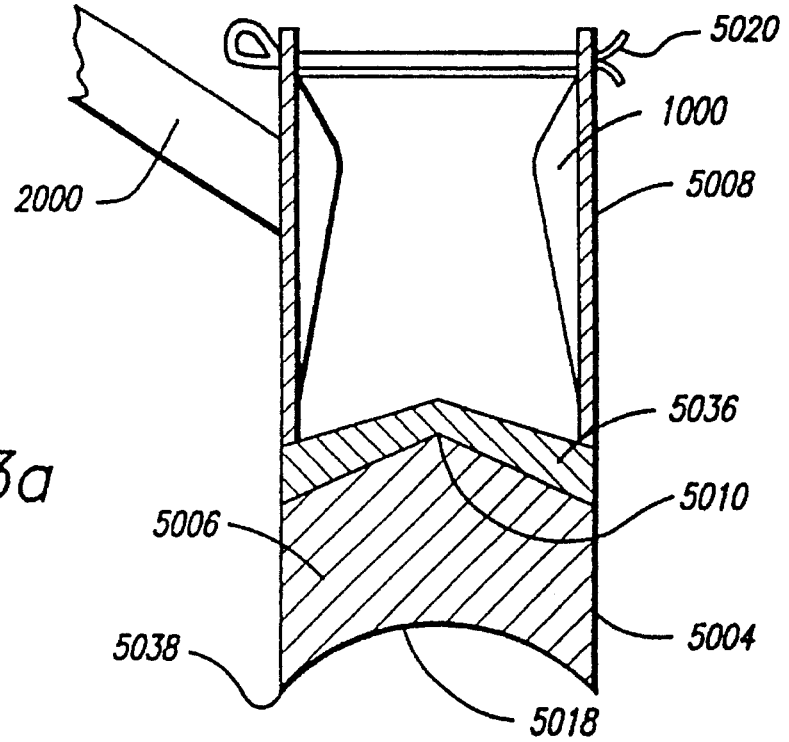
FIGS. 13*a*, 13*b*, and 13*c*, are side sectional, top, and side views respectively of a vaned insert plate used with the power vapor nozzle of this invention.
Figure 13B:
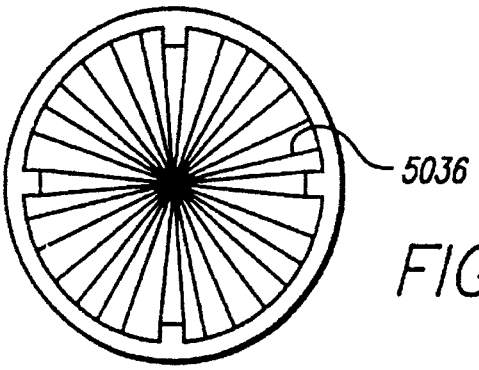
Figure 13C:
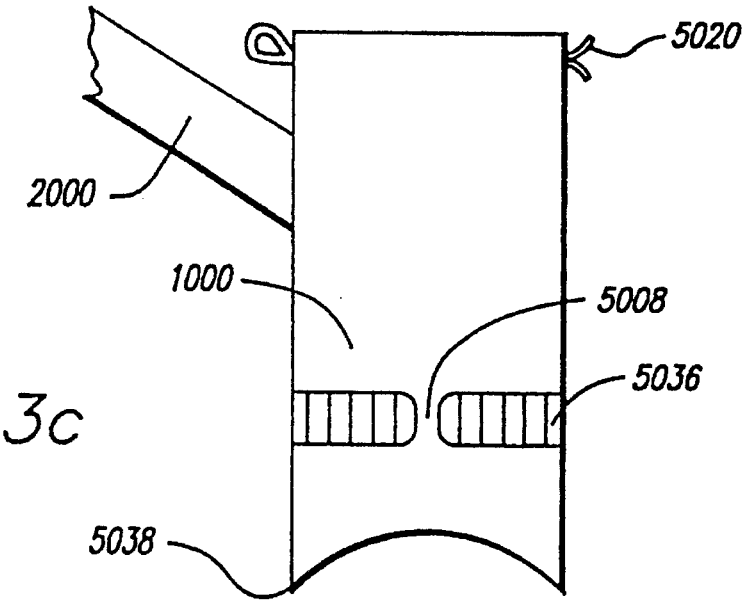

Turning now to FIGS. 13*a*, 13*b*, and 13*c*, a vaned insert plate 5036 is introduced. Power vapor nozzle 5000 in FIG. 13*a* has the concave base 5018 first described in FIG. 1 as part of tail piece 5004. Lips 5014 are absent but may be used. Instead the concavity of the base of tail piece 5004 creates a knife-like circumferential edge which is seen in FIGS. 13*a* and 13*c* as side points or trailing ends 5038. They extend in line with the sides of tail piece 5004 and away from the base 5018 of tail piece 5004.

Tip 5010 of crown 5006 again lies generally centrally of the base of power vapor nozzle 5000 and extends into the internal cavity below point 1004 of power vapor nozzle 5000. Fitting over crown 5006 and within opening 5012 and possibly formed integrally of power vapor nozzle 5000 is vaned insert plate 5036. Vaned insert plate 5036 is peaked in shape, corresponding at its base to the top shape of crown 5006 so that it fits against crown 5006. Evenly spaced, rectangularly configured vanes extend from its peak to its circumferential base to allow air and gas through.

A top view of the vaned insert plate 5036 is shown in FIG. 13*b*. While plate 5036 fits within opening 5012 extending between the outer circumference of power vapor nozzle 5000 and venturi 1000, it does not block opening 5012. The vanes of plate 5036 enable the mixture of fuel coming from the fuel line 2000 into the cavity extending through the center of the power vapor nozzle 5000 and air coming into the center of the power vapor nozzle 5000 to pass through and out openings between the vanes of plate 5036. These openings are at the area of opening 5012. This fact can be better appreciated upon a review of FIG. 13*c* where a side, non sectional view of a venturi 1000 fitted with a power vapor nozzle 5000 and vaned insert plate 5036 are shown. Joining walls 5008 are also well shown in this figure although if vaned insert plate 5036, power vapor nozzle 5000 and venturi 1000 are manufactured as one they may be dispensed with altogether.

It can be seen from FIG. 13*a* that if power vapor nozzle 5000 is not made integrally with venturi 1000, joining walls 5008 may extend so that power vapor nozzle 1000 may be sleeved over the outside of venturi 1000 and held in place by means such as a cotter pin 5020 extending through either side of the sleeve above venturi 1000.

Figure 14A:
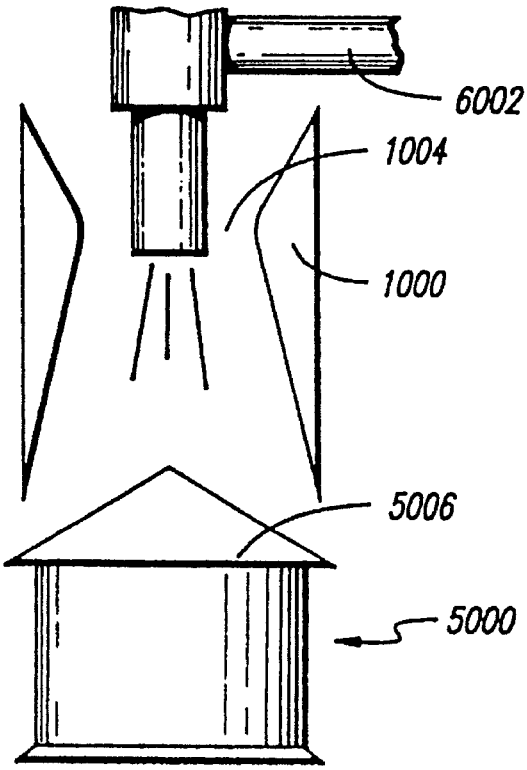
FIGS. 14*a*, 14*b*, and 14*c* are side sectional views of fuel injectors coupled with venturis and power vapor nozzles.
Figure 14B:
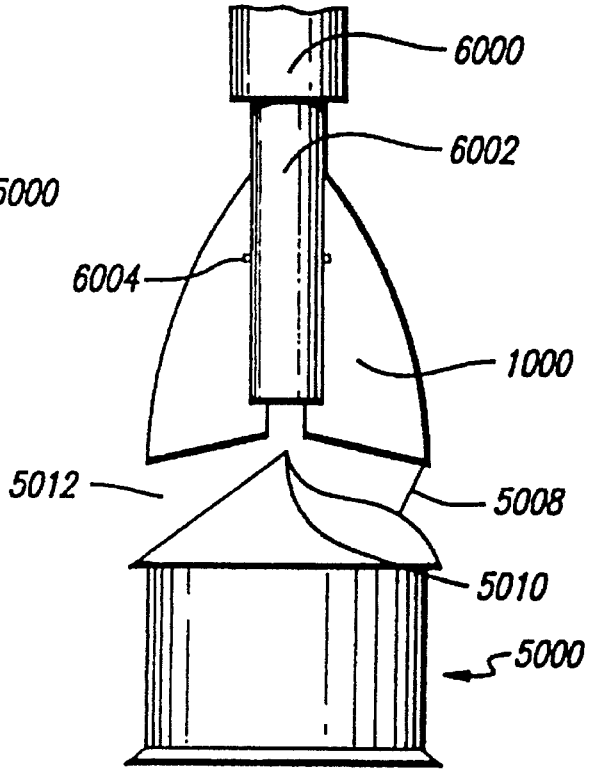
Figure 14C:
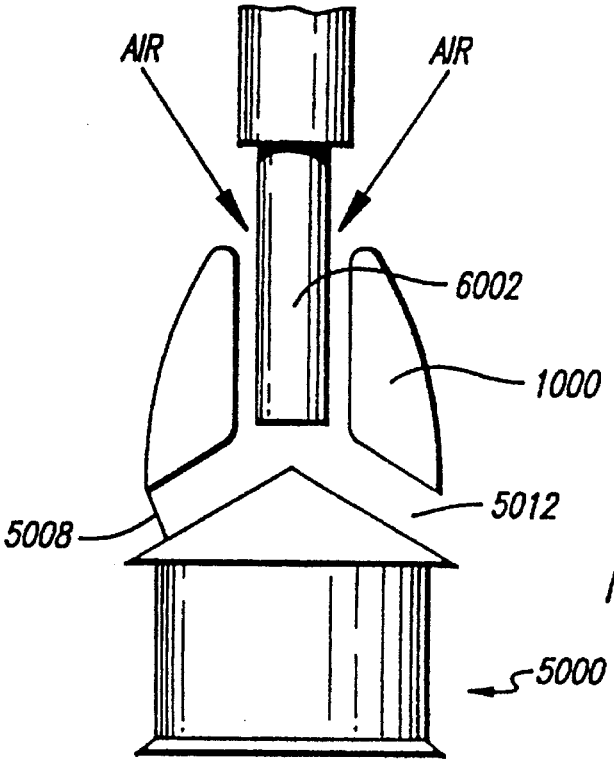

FIGS. 14*a* through 14*c* and 15*a* through 15*c* show the present invention used with fuel injectors 6000. In all of these figures, nozzle 6002 of fuel injector 6000 extends into venturi 1000 above power vapor nozzle 5000. In FIGS. 14*a* through 14*c*, the inside configuration of venturi 1000 causes its walls to take on a shape in cross section akin to two lungs.

Two basic types of fuel injectors known in the art are those that fog and those that dispense fuel in a straight stream. FIGS. 14*a*, and 14*c* are designed primarily for use with fogging injectors although with obvious modifications, straight stream injectors may be used. FIG. 14*b* is shown used with a straight stream fuel injector. In FIGS. 14*a* and 14*c*, injector nozzle 6002 extends into venturi 1000 but does not abut its inner surface. This enables air to flow past the sides of injector nozzle 6002. Crown 5006 is located spaced from nozzle 6002 and venturi 1000 so that fuel may be emitted from the nozzle to premix with surrounding air and then pass over crown 5006. Tip 5010 of crown 5006 is spaced below point 1004 while the end of nozzle 6002 is approximately at point 1004.

Power vapor nozzle 5000 in FIG. 14*b* shows the use of an ogee crown 5006. On the other hand, a triangular crown 5006 may be used. Tip 5010 does not come to a point at its end. Instead, its end is rather blunt and defines a concave surface therein. This concave surface lies within venturi 1000 at approximately that area of narrowest diameter 1004 and directly below but spaced from the end of injector nozzle 6002. It is located in line with the spray emitted from injector nozzle 6002. The ogee type crown 5006 and/or the concave tip 5010 may be used in other embodiments herein. Injector nozzle 6002 sits tightly between the lung shaped walls of venturi 1000 so that air cannot pass through the top of venturi 1000. To facilitate the seal between the inside surface of venturi 1000 and injector nozzle 6002, O-rings 6004 are used. The O-rings do not however, hold the injector 6000 or its nozzle 6002 in place. The injector 6000 or its nozzle 6002 is held in place by friction clips that interlock with venturi 1000 or by other known means.

In all of FIGS. 14*a* through 14*c*, between venturi 1000 and power vapor nozzle 5000 is again opening 5012 interrupted only where necessary by joining side walls 5008.

Figure 15A:
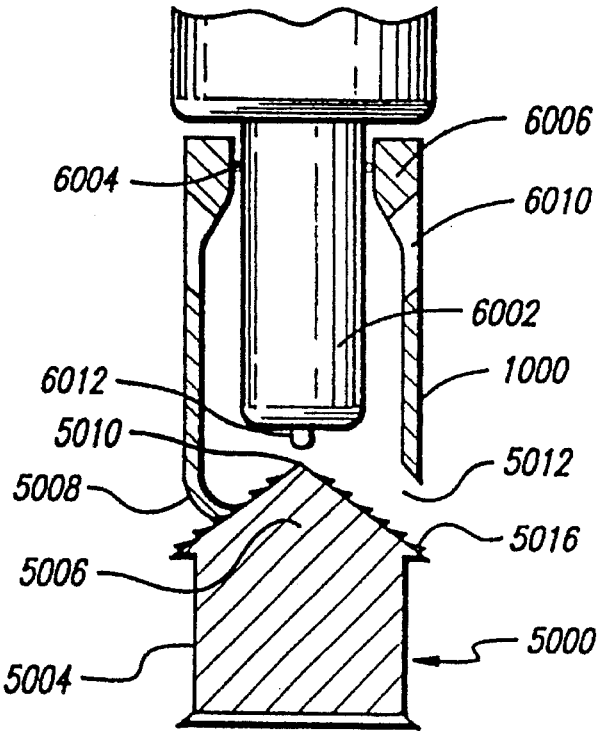
FIGS. 15*a* and 15*b* are side and side sectional views respectively of a connector for holding a fuel injector.
Figure 15B:
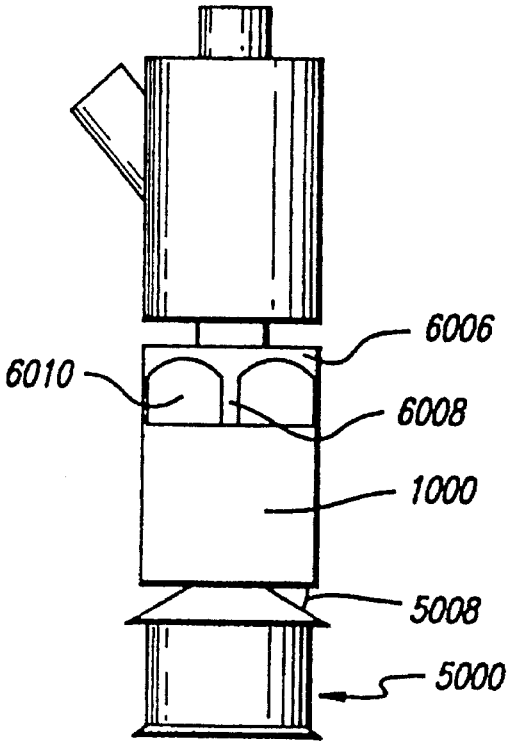

Turning to FIG. 15*a*, a fuel injection nozzle 6002 is again seen extending between the walls of a venturi 1000. Here the inside profile of the venturi walls are generally straight except at their lowermost ends where the inside wall curves to the outside wall to form a knife-like edge appearing as pointed ends in cross section. Attached to and above venturi 1000, and as well seen in FIG. 15*b*, is a connector 6006. Connector 6006 has an upper solid annular portion which has an outside diameter that is approximately the same as that of venturi 1000. Its inside diameter at the portion defining the solid annular section, is smaller than the inside diameter of venturi 1000 but approximately equal to the diameter of injector nozzle 6002. This enables injector nozzle 6002 to be tightly and sealing held by connector 6006 and yet extend into venturi 1000. To assist the sealing grip between connector 6006 and injector nozzle 6002, O-rings 6004 are again used. The O-rings do not however, hold the injector 6000 or its nozzle 6002 in place. The injector 6000 or its nozzle 6002 is held in place by friction clips that interlock with connector 6006 or by other known means.

Extending from the solid annular portion of connector 6006 are a number of generally straight side walls 6008 which connect to venturi 1000. The side walls act to define a number of open archways 6010 around the sides of connector 6006 such that the solid annular portion rests spaced from and above the top of venturi 1000. It is through archways 6010 that air passes into venturi 1000. This air passes alongside injector nozzle 6002 and out opening 5012. Thus connector 6006 seals the very top of venturi 1000. Air must then enter through archways 6010.

At the end of injector nozzle 6002 is spray or stream head 6012 through which the fuel is emitted. Head 6012 is located at the point where venturi 1000 begins to widen in its inside diameter. It is also located above tip 5010 of power vapor nozzle 5000 which is spaced therefrom situated below venturi 1000. On crown 5006 are scales 5016, serrations or knurling.

Figure 15C:
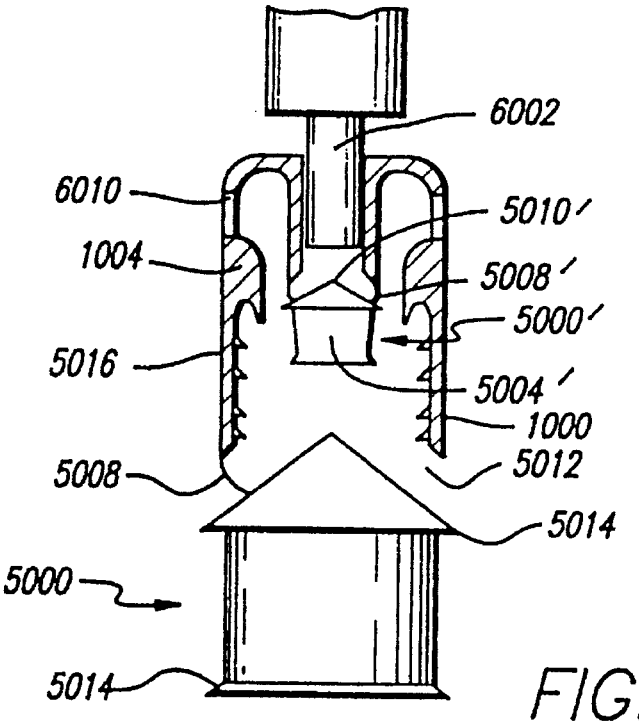
FIG. 15*c* is a side sectional view of a connector for holding a fuel injector and a second power vapor nozzle in a stacked fuel injector situation.

In FIG. 15*c*, two power vapor nozzles 5000 are used. The first nozzle 5000 is in that position heretofore described. That is, spaced from the base of venturi 1000 and extending slightly therein, its longitudinal center generally aligning with the longitudinal center of venturi 1000. Lips 5014 extend from the crown 5006 and the base and are preferably covered with scales 5016 or some roughening to minimize or stop pooling of fuel. The second nozzle 5000' is fully located within venturi 1000 and generally equally spaced from its inside walls so that its longitudinal central axis generally aligns with that of venturi 1000. Second power vapor nozzle 5000' is located at or just below that point 1004 where the inside diameter of venturi 1000 is at its narrowest. Second power vapor nozzle 5000' is connected to connector 6006 by joining side walls 5008'. Its tail piece narrows from crown 5006' to the base, and lips 5014' are seen both around the edge of crown 5006' and the base of power vapor nozzle 5000'. Second power vapor nozzle 5000' is also preferably covered with scales 5016 or appropriate roughening to minimize or prevent pooling of fuel.

Above second power vapor nozzle 5000' and spaced from tip 5010' is fuel injector nozzle 6002 held by connecting means 6006 and O-rings as described with respect to FIG. 15*a*. The O-rings do not however, hold the injector 6000 or its nozzle 6002 in place. The injector 6000 or its nozzle 6002 is held in place by friction clips that interlock with connector 6006 or by other known means. The connecting means 6006 arches on its outside surface from nozzle 6000 to the venturi sides 1000 by means of side walls 6008. Preferably, connecting means 6006 is formed as part of venturi 1000. Centrally, connecting means defines a tube of sorts in which fuel injector nozzle 6002 is held. The end of the tube has a knife-like edge in that the wall of the tube that rests against injector nozzle 6002 curves toward the outside wall of the tube that fronts side walls 6008. This configuration is aimed at preventing any fuel which adheres to this inside portion from pooling or forming a large film thereon.

Defined around the outer circumference of connecting means 6006 are spaced openings 6010 defined by side walls 6008. Side walls 6008 now arch into the top of connector 6006 so that the openings 6010 extend over the top of venturi 1000 from a point approximately opposite the end of nozzle 6002 on the sides of venturi 1000. The top portion of the walls of venturi 1000 are thin. They later widen abruptly below where the side walls 6008 of connecting means 6006 join venturi 1000. That point is approximately opposite the end of nozzle 6002. The abrupt widening of the wall of venturi 1000 toward the base of connecting means 6002 forms a hook-like ring structure inside venturi 1000 when taken in cross view. The tip of the hook-like ring is situated opposite tail piece 5004' of the second power vapor nozzle. Under this hook-like ring structure, the wall of venturi 1000 narrows to cause the base of venturi 1000 to come to a thin knife-like end. Thus the inside diameter of venturi 1000 widens between the hook-like ring and and base. This configuration is again to minimize or prevent pooling of fuel in sheets. Preferably the inside lower wall of venturi 1000 below the hook-like ring structure is covered with scales 5016 or inserts as earlier discussed to assist in keeping fuel from forming sheets thereon. The hook-like ring formation, and the pointed tapering walls of venturi 1000 all aid in keeping the fuel from adhering to the inside surface of venturi 1000 and directing the fuel back into the air passing through venturi 1000 and out opening 5012.

Figure 16A:
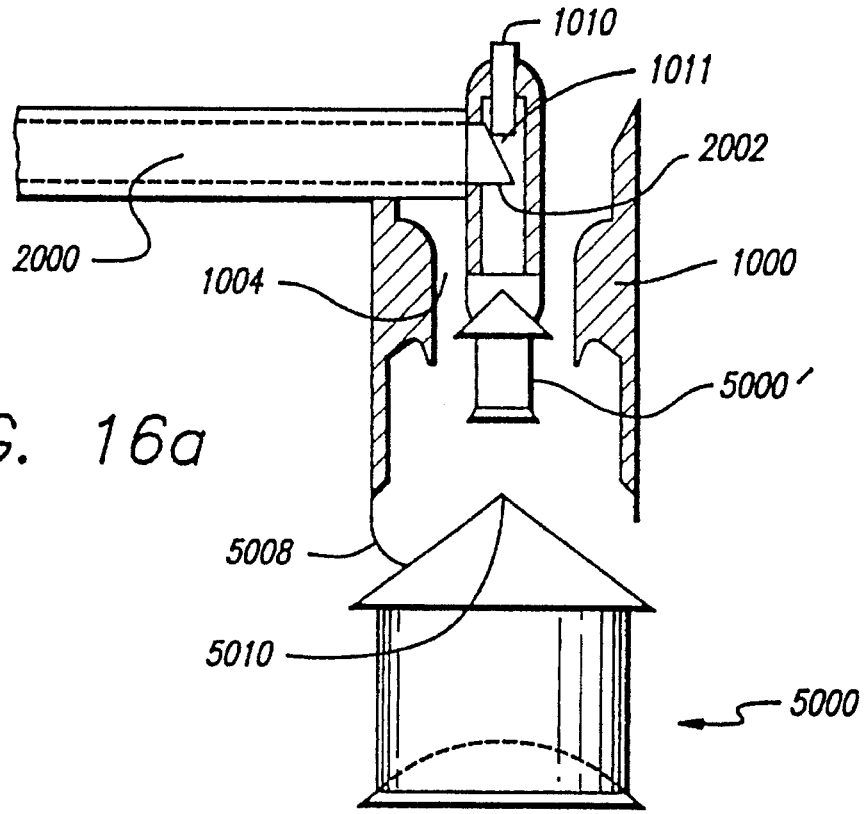
FIGS. 16*a* and 16*b* are side sectional views of two power vapor nozzles in use with a fuel line.
Figure 16B:
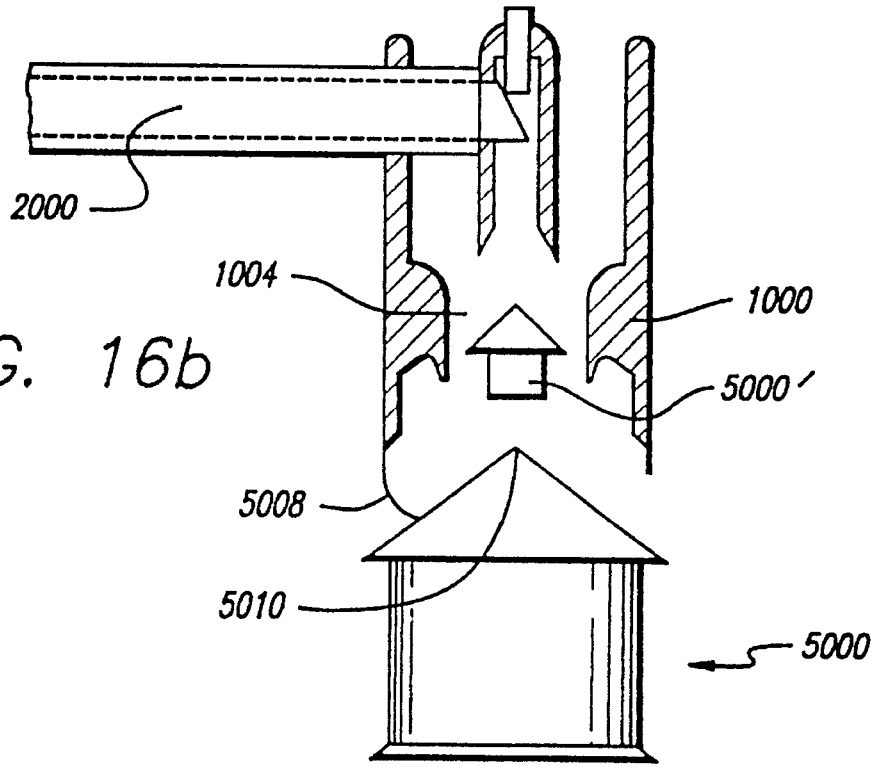

FIGS. 16*a* and 16*b* are similar to FIG. 15*b*. Again two power vapor nozzles 5000, 5000' are used and a venturi 1000 with a hooked ring interior is shown. It is of note that while in FIGS. 15*b*, 16*a*, and 16*b* the hooked ring venturi 1000 is preferable, the idea of two stacked power vapor nozzles 5000 may be as well used with a standard shaped venturi 1000. Second power vapor nozzle 5000' is in all instances placed at or below the area of maximum vacuum pressure 1004.

In FIGS. 16*a* and 16*b*, rather than a fuel injector 6000 being used, fuel line 2000 feeds into the top of venturi 1000 above the maximum vacuum pressure point 1004. In FIG. 16*a*, fuel line 2000 passes through one wall of venturi 1000 into inside tubular member 1008 which is fitted with lid 1010. Lid 1010 may have an air vent which is larger than a standard high speed air bleed. The vent is generally centrally located and opens into a straight pipe 1011 which extends below lid 1010 and just above the bottom lip 2002 of fuel line 2000. The bottom lip 2002 of fuel line 2000 extends further into the body of tubular member 1008 than the top of fuel 2000 and is formed by cutting the end fuel line 2000 at an angle. Both the diameter of lid 1010 and tubular member 1008 is such that they fit within venturi 1000 so that air may still easily pass into venturi 1000 from its top. Connected to the base of tubular member 1008 by joining side walls 5008' is second power vapor nozzle 5000'. A tubular member and a solid lid are known in the art. Air bleeds associated with a fuel line are known in the art. However, placing a vent centrally as here, through lid 1010 connected to straight tube 1011 which directs the air against an extending lip 2002 of a fuel line is believed unknown in the art.

FIG. 16*b* is almost identical to FIG. 16*a*. However here, second power vapor nozzle 5000' is placed very low in venturi 1000, as is the maximum vacuum point 1004. This places the base of power vapor nozzle 5000 much closer to tip 5010 of first power vapor nozzle 5000 which lies below the base of venturi 1000 and is connected thereto by joining side walls 5008.

Figure 17A:
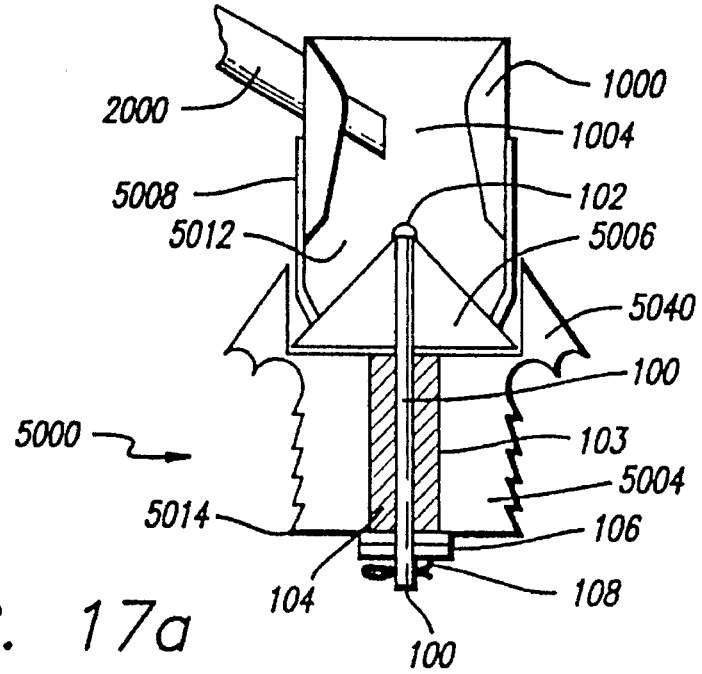
FIGS. 17*a* and 17*c* are side sectional views of a bat-like embodiment of the power vapor nozzle.
Figure 17B:
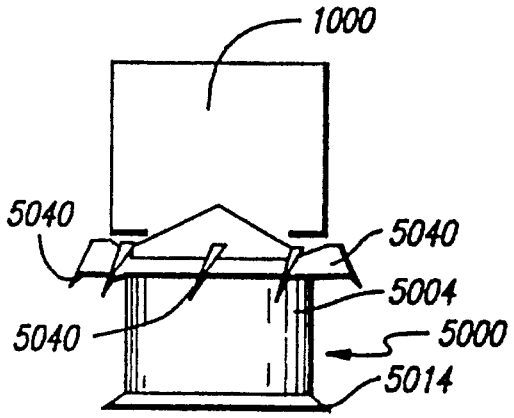
FIG. 17*b* is a perspective view of FIG. 17*a*.
Figure 17C:
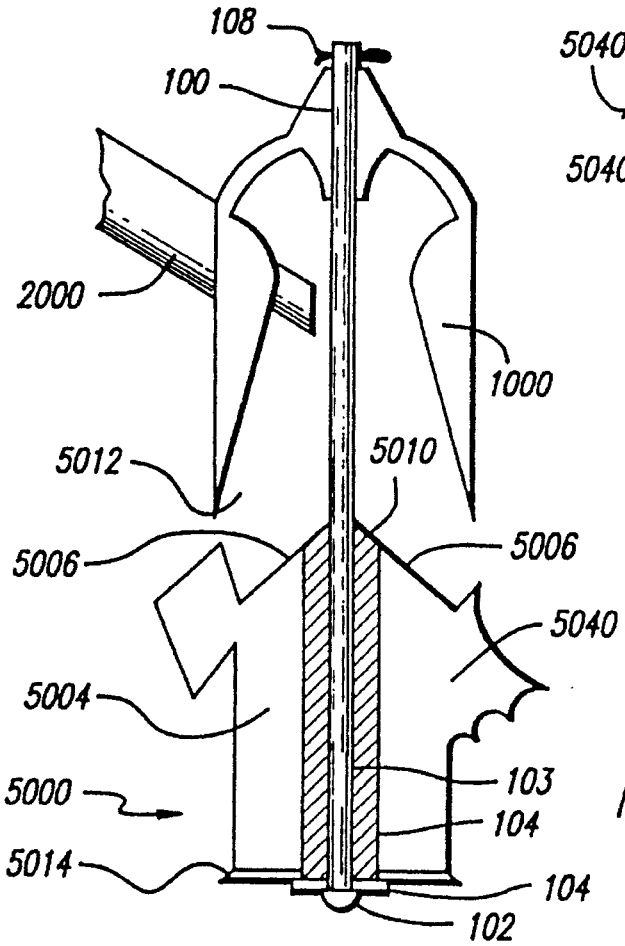

The shape of power vapor nozzle 5000 changes somewhat in FIGS. 17*a* through 17*c* such that in side sectional view, the device takes on the appearance of a bat. Tip 5010, crown 5006, and tail piece 5004 are still present. Lips 5014 are still preferably present at the base of tail piece 5004 but at the base of crown 5006, blades or bat wings 5040 prevent their formation. The crown edge still comes to a sharp edge. It just does not extend outwardly into a lip. It is preferred that at least blades/wings 5040 and preferably blades/wings 5040 and tail piece 5004 be made of a light material such as nylon, plastic, or metal alloy. Bat wings 5040 extend from the side of tail piece 5004 and on the side nearest crown 5006 extend straight up beyond the lower edge of crown 5006. Blades/wings 5040 may be in shape configured very much like bat wings, may take on more of a diamond-like shape as seen in the left-hand side of FIG. 17*c*, or may take on more of a squared or rectangular shape as seen in the right hand side of FIG. 17*c*. In FIG. 17*c*, the side of the wing 5040 nearest crown 5006 angles upwardly beyond the base of crown 5006 rather than extends straight up as seen in FIG. 17*a*. Further in FIG. 17*c*, the option of forming crown 5006 as part of tail piece 5004 is shown. Wings 5040 are never intended to fully block opening 5012.

The lower outside portion of wing 5040 joins tail piece 5004 below crown 5006 in the upper half of tail piece 5004. It could, however, extend to the mid-portion or taper toward the base of tail piece 5004. In any event, the outside surface of tail piece 5004 has points or hooks so that in side section, the appearance of the ribs of a bat wing are present with the skin stretching between each rib. This could be accomplished with scales 5016 earlier described herein.

From the uppermost point of wing 5040 to its end, it may arc from point to point as it defines the shape of the wing. It is to be understood that the wings 5040 are a plurality of blades and that they do not prevent the air from escaping out opening 5012. They are spaced from venturi 1000. Fewer blades or wings are preferred for higher speed engines since the tail piece 5004 and wings 5040 will spin faster in such instances. The top edges of each blade or wing 5040 are spaced down further from the base of venturi 1000 in faster running engines.

A perspective view of the device of FIG. 17*a* is in FIG. 17*b*. FIG. 17*b* well illustrates the separation of each blade/wing 504 and the manner in which the blades/wings extend around the circumference of power vapor nozzle 5000. Wings 5040 are placed at an angle with respect to the central longitudinal axis of power vapor nozzle 5000 to facilitate the spinning of power vapor nozzle 5000. The number of blades/wings 5040, their angle, and their distance from venturi 1000 will govern the speed of rotation of wings 5040 and tail piece 5004 at a given air flow. The wings/blades 5040 angle to a greater degree with respect to the longitudinal axis of the power vapor nozzle 5000 and more blades are used for lower RPM applications. The converse is true for higher RPM applications for a given venturi 1000 diameter. Lip 5014 at the base of tail piece 5004 is also preferably configured into a blade-like situation.

Extending from crown 5006 are curved joining side walls 5008 connecting power vapor nozzle 5000 to the base of venturi 1000. Of course, if venturi 1000 is retrofit with power vapor nozzle 5000, the joining side walls 5008 will extend up along the outside of venturi 1000 to clip power vapor nozzle 5000 to it. This is seen in FIG. 17*a*. Tip 5010 again extends generally centrally of and into the base of venturi 1000 and fuel line 2000 extends above power vapor nozzle 5000 into venturi 1000 at about its maximum pressure point 1004.

Extending through the longitudinal center of power vapor nozzle 5000 is pin 100. Its head 102 may be shaped to form tip 5010, or it may recess into tip 5010 and be covered with a cap which completes the form of tip 5010. From crown 5006 to the base of tail piece 5004, pin 100 is surrounded by bushing 103 which is preferably made of a metal material such as bronze or brass. The base of tail piece 5004 is flat in this embodiment, and the pin shaft extends out the center of the base into a retaining washer 106 and then is held in place by cotter pin 108. The base could also be concave causing cotter pin 108 to be recessed within the base of tail piece 5004.

In FIG. 17*a*, crown 5006 is clearly a separate piece from tail piece 5004 and wings 5040. Bushing 103 is press fit into tail piece 5004 and then the two are slipped onto the shaft of pin 100 and retained there by retaining washer 106 and cotter pin 108. In this way, tail piece 5004 and wings 5040 may spin about the shaft of pin 5040 as air passes out of opening 5012.

As alluded to earlier, FIG. 17*c* is very similar to FIG. 17*a*. Wings or blades 5040 are shown on one side to be square or rectangular in configuration. A lower knife like edge seen as a point in FIG. 17*c* extends from the bottom corner on one side of the rectangular or square wing. The diamond-like configuration on the other side negates the need for formation of this point although the lower pointed edge of the diamond like shape could be exaggerated to emphasize this point. The point or knife-like ege is again to facilitate the dispersal of fuel into the air. The different wings/blades 5040 in FIG. 17*c* is for example only. In reality, only one configuration would be used. In FIG. 17*c*, pin head 102 enters the center of power nozzle 5000 at its base and the pin shaft extends out of tip 5010 along the longitudinal center of venturi 1000 to connect to a top piece 1006 which connects by rounded side supports to the outside edges of venturi 1000. The shaft of pin 100 is anchored in top piece 1012 again by retaining washer 106 and cotter pin 108. Top piece 1012 is generally flat in configuration, acting merely to bisect the opening of venturi 1000 and not to interfere with the flow of air therein. Bushing 103 extends throughout the entire length of power vapor nozzle 5000 so that all of power vapor nozzle 5000 spins on pin 100. In this instance, joining side walls 5008 are dispensed with altogether since the shaft of pin 100 connects power vapor nozzle 5000 to venturi 1000. The positioning of power vapor nozzle 5000 on pin 100 may vary to adjust the distances between power vapor nozzle 5000 and venturi 1000. Note again, that in FIG. 17*c*, crown 5006 is part of and integral with the tail piece 5004. Thus power vapor nozzle 5000 is one piece.

In all of the embodiments of FIGS. 17*a* through 17*c* the wing or blade 5040 surfaces preferably are serrated, covered with scales or otherwise treated to prevent the fuel from forming into sheets thereon.

FIGS. 18*a* and 18*b* are modifications of power vapor nozzle 5000. Power vapor nozzle 5000 is now bullet-like in shape, with the tip of the bullet being at the top end of carburetor opening 500. This means that the top of power vapor nozzle 5000 in this embodiment is sealed from incoming air. Lips 5014 divide the top of the bullet from the bottom and also extend around the base of the bullet. The top of the bullet will again be referred to as the crown 5006 and its tip 5010. The bottom will still be referred to as the tail piece 5004. If the power vapor nozzle 5000 is being used with a fuel injector 6000, as in FIG. 18*a*, the fuel injector nozzle pierces tip 5010 and extends along the longitudinal center of power vapor nozzle 5000. If, instead, this embodiment is connected to fuel feed line 2000 as in FIG. 18*b*, fuel feed line 2000 will enter the side or top of crown 5006. In either event, an internal connecting passageway will be defined in the crown 5006 which communicates with the end of either the fuel feed line 2000 or fuel injector 6000 so that the fuel may pass out of opening 5012 defined between the top of lip 5014 and the base of crown 5006. Connecting passageways are shown in both FIGS. 18*a* and 18*b*. These embodiments are different from the previous embodiments for two reasons. First, in the previous embodiments fuel and air exits out of opening 5012. Second, in the previous embodiments, opening 5012 extends around the circumference of the vapor nozzle 5000. Here only fuel exits from opening 5012. Further, here, opening 5012 is comprised of a plurality of openings 5012 defined by archways or frames 5042 which extend around the circumference of vapor nozzle 5000. FIG. 18*c* is a detailed view of openings 5012 and frames 5042. In this figure, joining side walls 5008 are no longer required. In the alternative, opening 5012 could be an annular opening 5000. In such an instance, the opening should be very narrow, in the range of $1/10{,}000$ to $1/30{,}000$ of an inch in width. In such alternative design, joining side walls 5008 are necessary and a minimal number of these are required to join crown 5006 to tail piece 5004. Lip 5014 or a plurality of scales 5016 or serrations or knurling making up lip 5014 would still be present at the bottom of opening 5012.

In FIGS. 18*a* and 18*b* power vapor nozzle 5000 is almost completely or is completely located within carburetor opening 500. It is spaced from the inside walls of carburetor opening 500 so that air can pass through carburetor opening 500. Openings 5012 are located at about the point of maximum pressure 504 inside of carburetor opening 500. Preferably, tail piece 5004 is covered with scales 5016 or knurling or serrations and again, the inside of carburetor opening 500 walls below the point of maximum pressure 504 is also covered with scales 5016, serrations or knurling.

As noted above, FIG. 18*c* is a detailed view of the use of a plurality of side by side openings 5012. Here, instead of being generally open around the entire circumference of power vapor nozzle 5000, interrupted by a minimal number of joining side walls 5008, opening 5012 is a plurality of openings. The idea of a plurality of small openings per se is not new. U.S. Pat. No. 3,664,648 disclosing the invention of a Mr. Seeley Jr. teaches these. The Seeley openings are arranged in stacks and are surrounded by square protrusions which form ledges. This design has been found to be problematic. Fuel which exits these openings rests on the first ledge until it pours onto the second ledge. There, the fuel forms into a ball as it exits the end of the last ledge at lower RPM ranges. Other U.S. Patents which consider a plurality of annular openings are:

U.S. Pat. No. 2,702,185 (Lavin)
U.S. Pat. No. 1,816,756 (Whatmough)
U.S. Pat. No. 1,941,658 (Bucherer)
U.S. Pat. No. 1,949,031 (Weber)
U.S. Pat. No. 2,783,983 (Benvenuti)
U.S. Pat. No. 1,889,687 (Mennesson)
U.S. Pat. No. 1,982,945 (Armstrong).

Figure 18D:
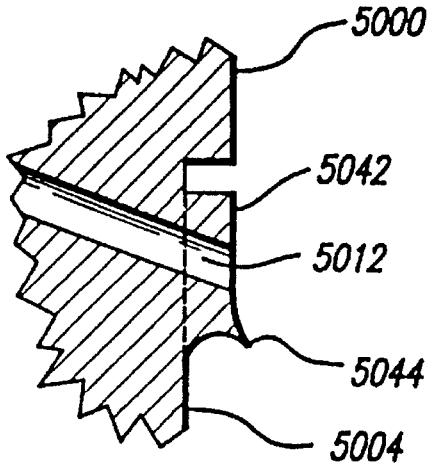
FIG. 18*d* is a side view of one opening and its frame and ledge as seen in FIG. 18*c*.

All of these devices suffer from the same problem. The fuel balls into a solid ring around the device at low RPMs. The present invention improves upon the teachings of these inventions. In the present invention, each opening 5012 is preferably circular and encased in the upper two-thirds of arched frame 5042 which protrudes away from the surface of the outside of power nozzle 5000 and forms a housing around each opening 5012. The protrusion may be accomplished by thickening the wall around each opening 5012, or recessing the surface of power vapor nozzle 5000 around each frame 5042. The upper rounded portion of the arched frame 5042 represents the top of the frame and is the portion in which openings 5012 are defined. The lower portion of the frame has extending from it ledge 5044 which is shaped like one of scales 5016. With this design, fuel is kept from forming sheets or a row of balls on the outside surface of power vapor nozzle 5000. A side view of frame 5042 and ledge 5044 is shown in FIG. 18*d*. The underside of ledge 5044 forms a curved shape so that a plurality of ledges performs the same function as ring 5022 earlier described herein.

Figure 18E:
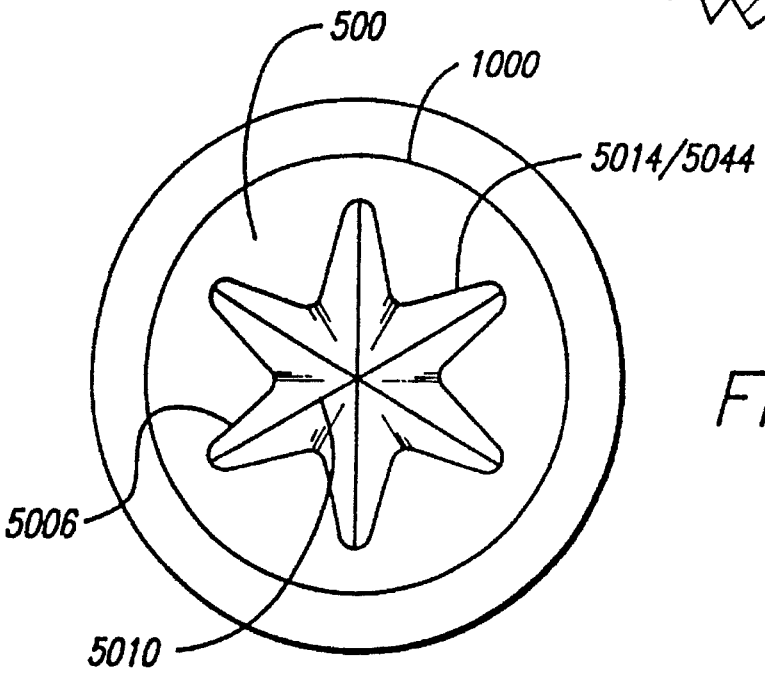
FIG. 18*e* is a top view of a modified version of the bullet-like design of the power vapor nozzle of FIG. 18*a*.
Figure 18F:
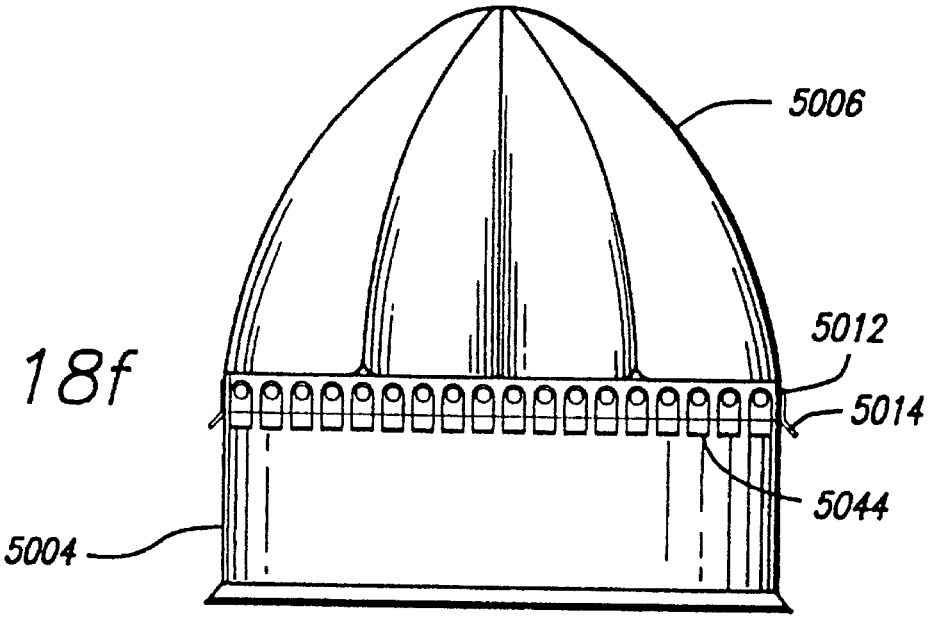
FIG. 18*f* is a perspective view of FIG. 18*e*.

FIGS. 18*e* and 18*f* disclose a modification of FIGS. 18*a* and 18*b*. FIG. 18*e* is a top view of the modified embodiment and FIG. 18*f* is a side view. Crown 5006 is formed in its bullet-like configuration but is modified to include indentations which give it a star-like shape when viewing it from the top. In FIG. 18*e* this top view is seen with carburetor opening 500 marked on the outside. This embodiment may be used with a fuel injector 6000 or fuel line 2000, either being introduced into crown 5006 as shown in FIGS. 18*a* and 18*b*. Either the plurality of openings 5012 or the single narrow opening 5012 may be used with this embodiment. In the latter case, the placement of joining side walls 5008 is again important. They must not negatively affect the distribution of fuel through opening 5012.

FIG. 18*f* shows the use of the plurality of openings 5012, these openings being encircled by frames 5042. This embodiment is preferable when using propane and natural gas. In this embodiment, power vapor nozzle 5000 is mounted on a central shaft so that it may spin on the shaft as air enters carburetor opening 500. Fuel feed line 2000 is located in the tip 5010 of crown 5006 so that crown 5006 can spin around it. To assist nozzle 5000 in its spin, the star takes on a pinwheel configuration.

Figure 18G:
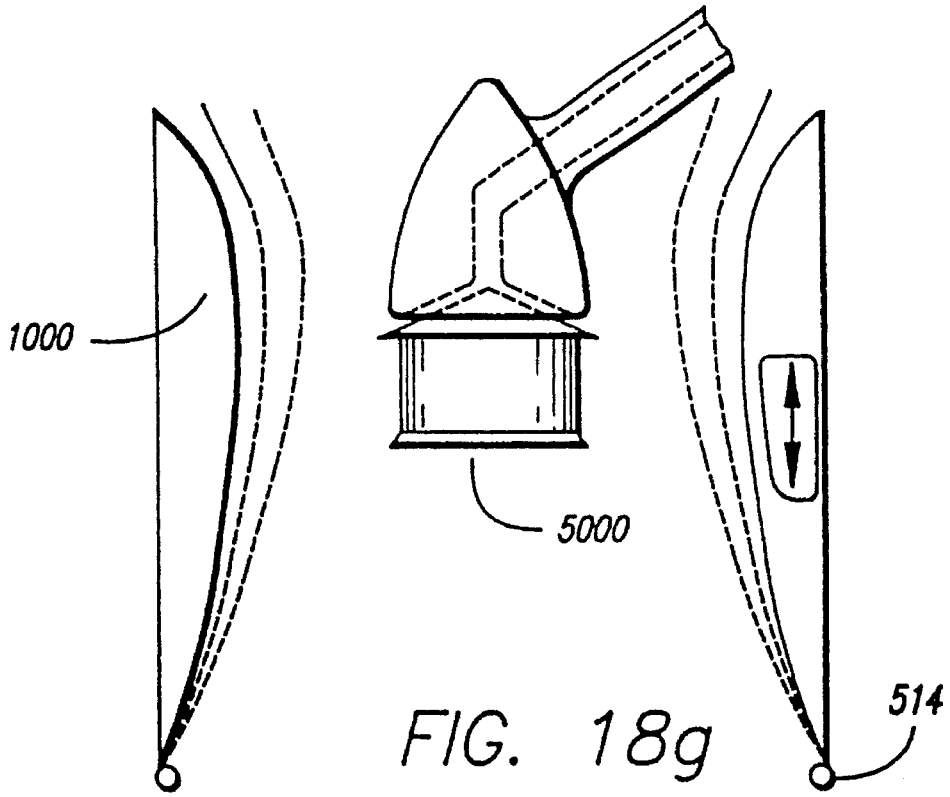
FIG. 18*g* is a side view of a bullet-like power vapor nozzle in a variable carburetor opening.

In FIG. 18*g*, a power vapor nozzle 5000 such as that shown in FIGS. 18*a* and 18*b* is depicted. It is located within a variable carburetor opening 500 and held in place there by its connection to fuel line 2000. If a fuel injector nozzle 6002 is used obvious minimal to noninterfering means will be used to hold power vapor nozzle 5000 in place. That is, a carburetor opening 500 that may be adjusted so that its inside diameter may be altered. The dotted lines disclose various positions that the side walls of carburetor opening 500 may take. At the base of carburetor opening 500 is pivot point 514. The walls of carburetor opening 500 are comprised of a plurality of overlapping petals which move forwardly or rearwardly on pivot 514 thereby narrowing or increasing respectively, the inside diameter of carburetor opening 500. The manner of moving the petals in this fashion in response to changes in RPM will be obvious to those skilled in the art. Use of a variable carburetor opening 500 enables one to dispense with the need for an engine throttle. When a variable carburetor is used, the only air restriction is within carburetor opening 500 and maximum vaporization may be achieved through the RPM ranges. While carburetor opening 500 has been described in this embodiment as being comprised of a plurality of petals, it instead could be made of one sheet of material that folds upon itself to give the effect of having a plurality of petals. However, separate petals are preferable for greater accuracy in desired diameters.

Figure 18H:
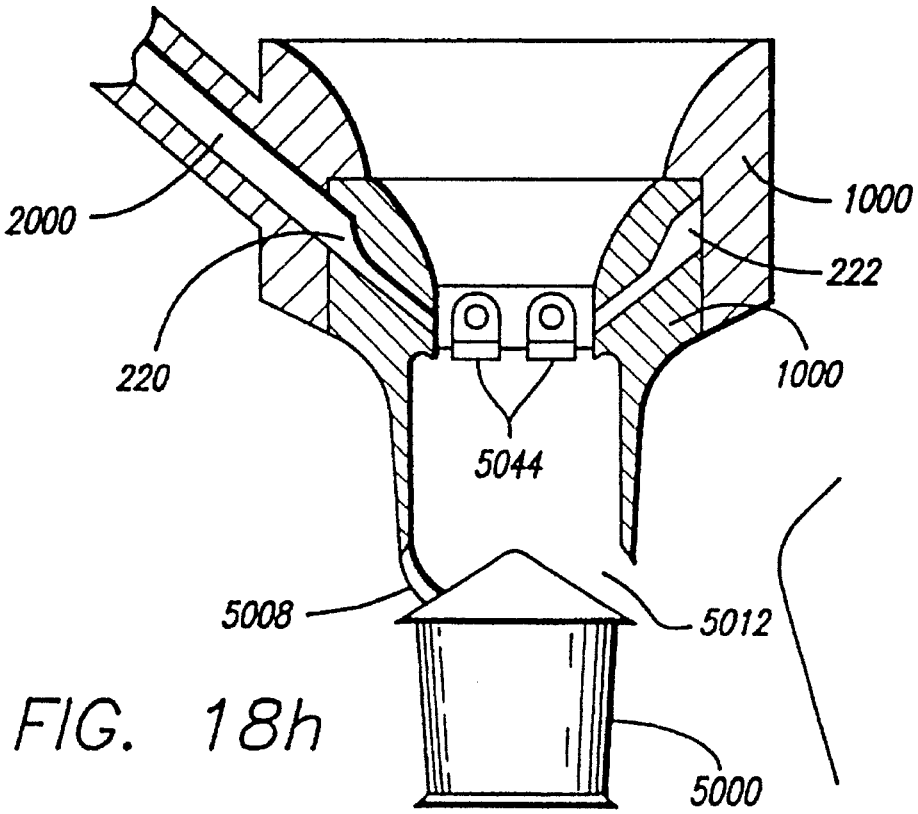
FIG. 18*h* is a side sectional view of a modified version of a venturi with separated fuel openings.

FIG. 18*h* returns us to a modification of the power vapor nozzle 5000 of this invention. This nozzle 5000 is particularly useful on an annular inner discharge such as found in carburetors manufactured by the Ford company. The standard carburetor fuel line 2000 is shown feeding into the top of venturi 1000. However, the top of venturi 1000 has defined around its periphery a cavity 222 through which the fuel travels. On the inner wall of this cavity 222 are a plurality of openings 220 so that the fuel can empty through the openings into the air opening defined generally centrally of the venturi 1000 and then exit out of the annular opening 5012. Openings 220 are surrounded by frames 5042 and ledges 5042 as described with respect to FIG. 18*c*. Cavity 222 and openings 220 are located just above the point 1004 which point is defined by ledges 5044. Again, power vapor nozzle 5000 is shown attached by joining side walls 5008 to the base of venturi 1000 which is of wider diameter internally than point 1004.

Figure 18I:
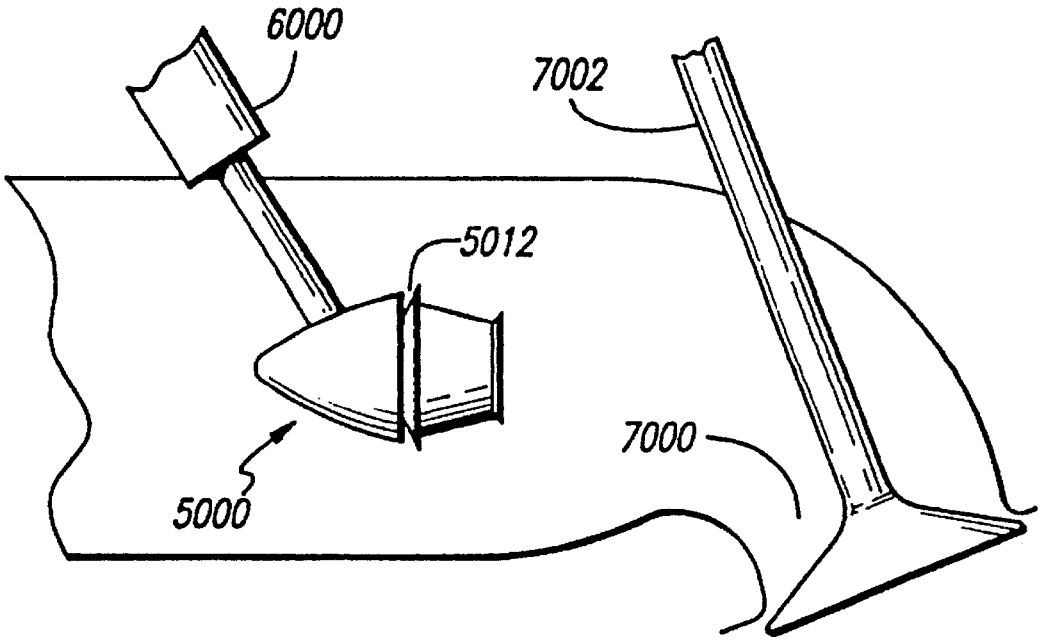
FIGS. 18*i* and 18*j* are diagrammatic views of the power vapor nozzle of FIGS. 1*a* and 18*a* in an intake port.
Figure 18J:
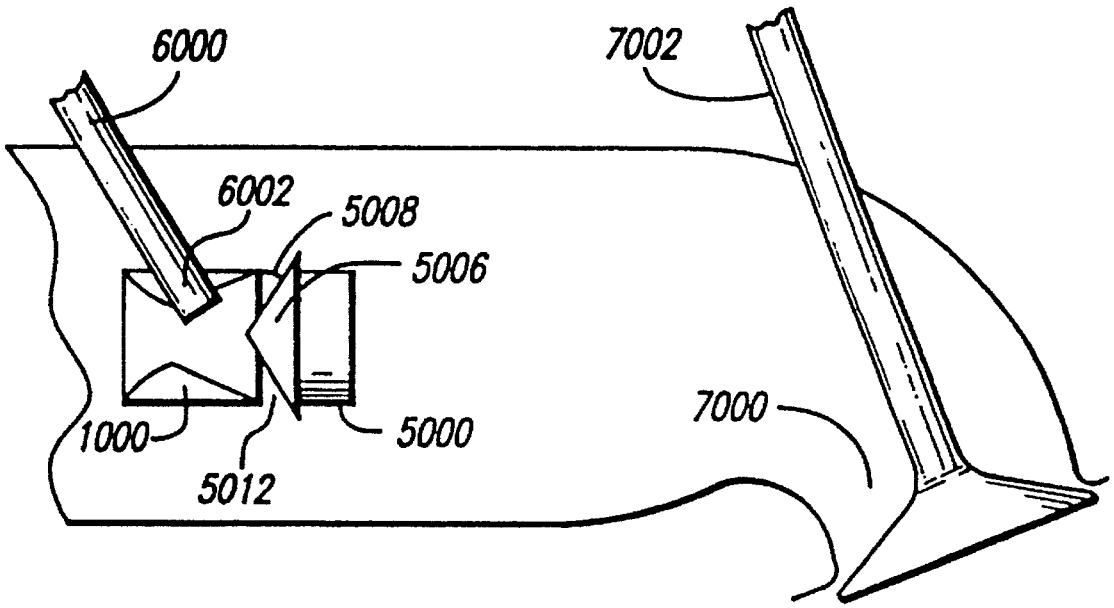
Figure 18K:
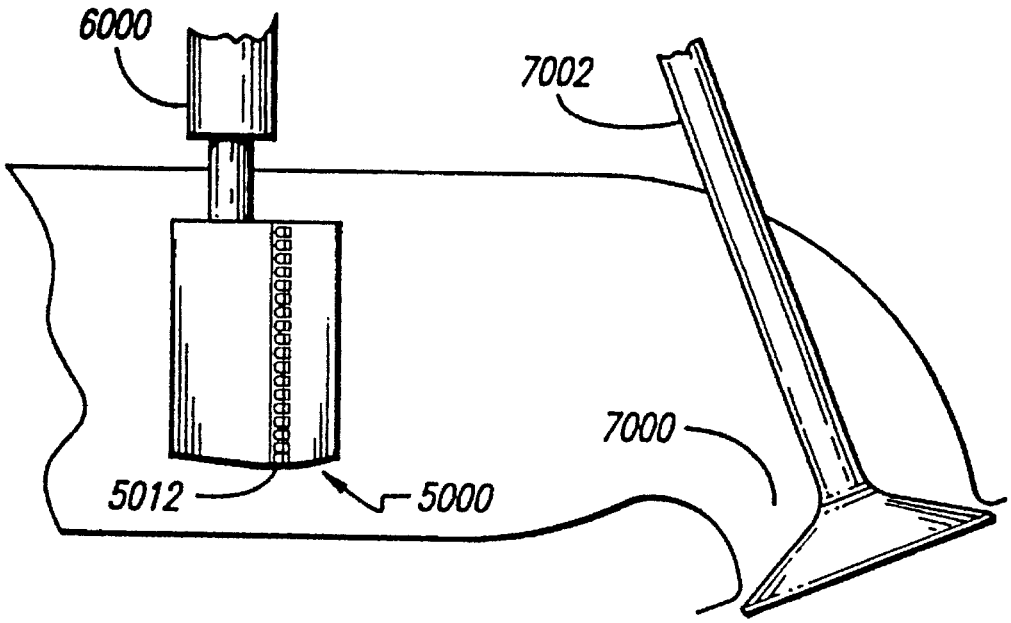
FIG. 18*k* is a diagrammatic view of a modified version of a power vapor nozzle in an intake port.

FIGS. 18*i* through 18*k* are power vapor nozzles 5000 placed within an intake port 7000 with an intake valve 7002 connected to its outlet. In each instance an injector nozzle 6002 is associated with the nozzle 5000. In FIG. 18*i* a bullet-shaped power vapor nozzle as disclosed in FIGS. 18*a* and 18*b* is situated so that its longitudinal axis parallels that of intake port 7000. Crown 5006 is furthest from the outlet and intake valve 7002 of intake port 7000. Injector nozzle 6002 extends through intake port 7000 into crown 5006. Gas from nozzle 6002 will exit out opening or openings 5012 to mix with the air passing through intake port 7000.

In FIG. 18*j* a nozzle 5000 and venturi 1000 such as that seen in FIG. 1 is situated with their longitudinal axes parallel to that of intake port 7000. Fuel injector nozzle 6002 again passes through fuel intake port 7000 into venturi 1000 so that fuel emitted therefrom passes over crown 5006 and out opening 5012. Venturi 1000 and crown 5006 are situated furthest from the outlet of intake port 7000 and intake valve 7002.

Figure 18L:
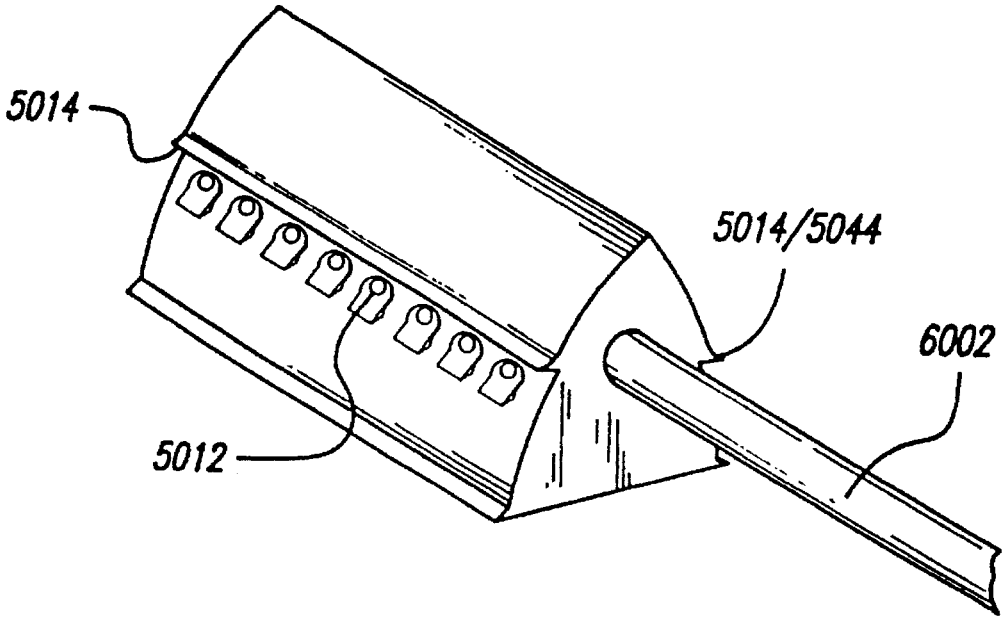
FIG. 18*l* is a perspective view of the power vapor nozzle of FIG. 18*k*.

FIG. 18*k* is a new embodiment of a power vapor nozzle 5000. Here, power vapor nozzle 5000 is wedge-shaped as better seen in FIG. 18*l* and closed at all ends as was the case with the bullet-shaped power vapor nozzle 5000 of FIGS. 18*a* and 18*b*. Viewing this nozzle from the top as can be done in FIG. 18*l*, the nozzle looks like a barn with the tip of the roof marking the front of the nozzle and the base of the barn denoting the back of the nozzle. Entering the top of power vapor nozzle 5000, is fuel injector nozzle 6002. Fuel from fuel injector nozzle 6002 feeds out opening or openings 5012 which here extend along the sides of nozzle 5000 from its top to its bottom. Lip 5014 or ledges 5044 making up lip 5014 of nozzle 5000 parallel the extension of opening or openings 5012. If a plurality of openings 5012 are used, then the arrangement earlier described with respect to FIG. 18*c* is applicable. If a single opening is used, then the width consideration noted with respect to FIG. 18*b* is applicable. When placed in intake port 7000, openings or opening 5012 are/is perpendicular to the longitudinal axis of intake port 7000.

The embodiments of FIGS. 18*i* and 18*j* are best adapted for use with a round intake port while the embodiment of FIG. 18*j* is best adapted for use with a rectangular or square intake port. While a single intake port 7000 is used for FIGS. 18*i* through 18*k*, it is to be understood that all three power vapor nozzles are not intended to be in one intake port 7000. One power vapor nozzle per intake port preferably would be used although circumstances could dictate otherwise.

Figure 19A:
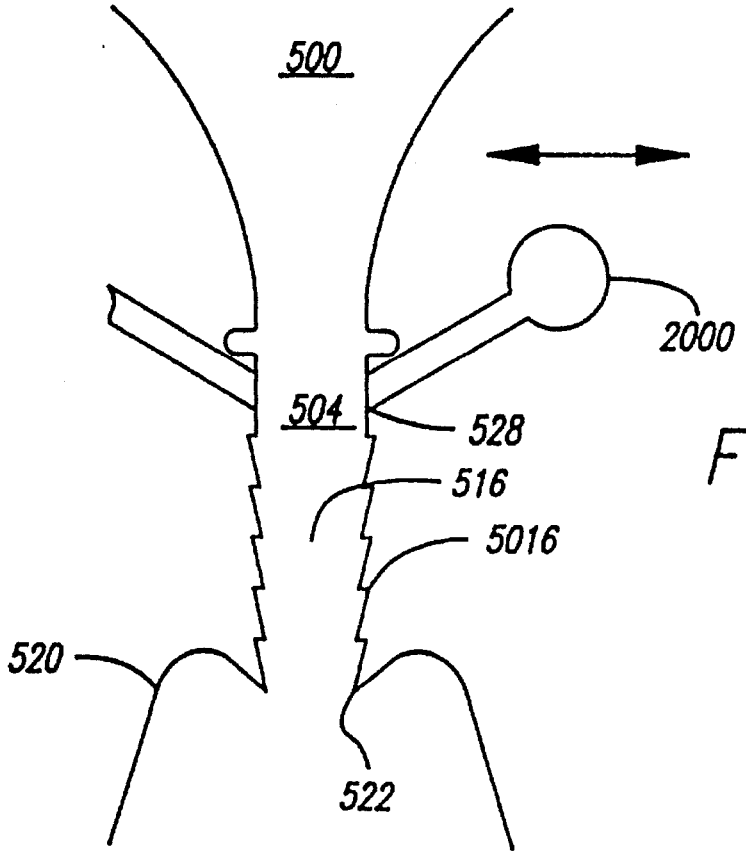
FIGS. 19*a* and 19*b* are diagrammatic side views of modified carburetor openings.

FIG. 19*a* is a carburetor opening 500 that is built to obviate the need of a power vapor nozzle 5000. In its upper half into which air first enters, carburetor opening 500 narrows gradually from a wide diameter to a long neck 516 of maximum pressure drop. Carburetor opening 500 thus takes on a funnel-like shape in this area. The neck area becomes the area 504 of maximum pressure drop. In this neck area of maximum pressure drop 504, at least one opening 528 is present. In FIG. 19*a*, two openings 528 are shown on either side of the neck. Around opening 528 is a frame 5042 and ledge 5044 both as described with respect to opening 5012 in FIG. 18*c*. Fuel is fed into each opening 528. Below ledge 5044 are a plurality of scales 5016 or serrations or knurling which line the inner surface of neck 516. Neck 516 ends abruptly such that the last layer of scales 5016 or serrations or knurling brings that neck end to a sharp knife-like edge which in cross section appears as point or trailing edge 522. The base of carburetor opening 500 then abruptly arcs upwardly and away from the base of the neck so that in the side sectional view of FIG. 19*a*, neck 516 appears to join hunched shoulders 520. This causes the sharp knife-like edge of neck 516 to form trailing edge 522.

Figure 19B:
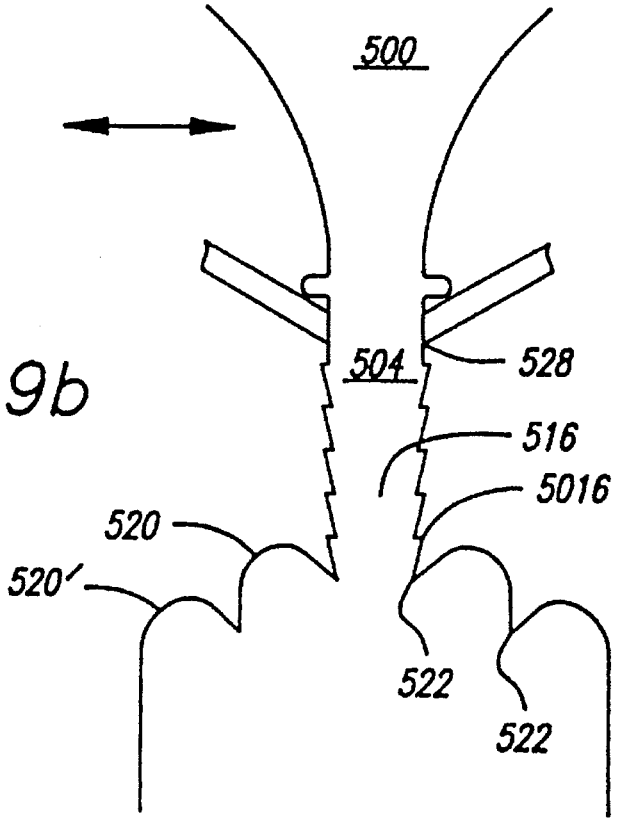

FIG. 19*b* is almost identical to FIG. 19*a* except that two sets of shoulders 520 are formed, one below the other. This creates two sets of internal knife-like edges or trailing edges 522. One is at the joinder of neck 516 and the first set of shoulders 520. The other is at the joinder of the first set of shoulders 520 and the second set of shoulders 520'. If desired, the internal surfaces of shoulders 520 and 520' may be lined with scales 5016 serrations or knurling so as to better facilitate the prevention of fuel forming sheets or balls on the inside surfaces of carburetor opening 500 below the point of the introduction of the fuel into carburetor opening 500. However, the severe arcing up and away of the carburetor wall opening to form each trailing edge 522 itself acts to prevent the lining and puddling of fuel. As many sets of shoulders 520 as desired may be included.

Both FIGS. 19*a* and 19*b* may be constructed as variable carburetor openings 500 as in FIG. 18*g* or as discussed in the following figures. Rather than varying each carburetor opening 500 at a base pivot point as in FIG. 18*g*, the carburetor opening 500 may be constructed so that the walls move away from and toward each other uniformly. In this way the diameters along the entire length of the carburetor opening 500 are changed equally. Adjustment means to accommodate this situation are well known to those skilled in the art.

Figure 19C:
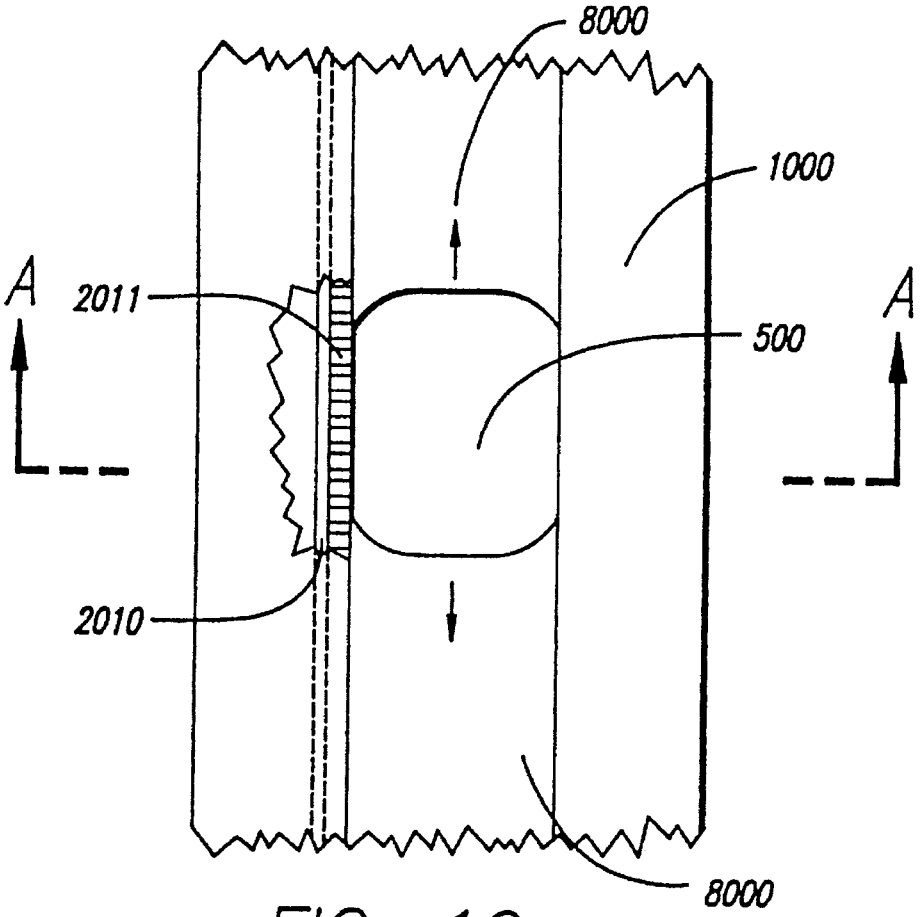
FIG. 19*c* is a top view of a carburetor opening with two sliders therein for varying the side of the carburetor opening.

To accomplish adjustability of a carburetor opening 500 as discussed in the preceding paragraph, sliders 8000 may be used. These are seen in FIG. 19*c* which is a top view of a carburetor opening 500 with sliders 8000 slidably engaged therein. As can be seen from this figure, two sliders 8000 are used. Each has a curving face that abuts the other so that the two faces form a circular or oval opening when brought against each other, as seen in FIG. 19*c*. This circular or oval opening effectively becomes the carburetor opening 500 since the remainder of the carburetor opening is blocked by the body of the slider 8000. Instead, one slider 8000 may be used so that the effective carburetor opening 500 is formed with the curved face of the slider 8000 and the edge of the actual opening 500 of the carburetor. As one slider 8000 or both sliders 8000 move away from the edge of the carburetor or each other as the case may be, the opening 500 becomes larger. As the opening 500 becomes larger, more fuel openings are exposed. In this regard, multiple fuel openings 2011 are included in this design. These multiple fuel openings 2011 connect to a common channel 2010 which connects to fuel line 2000. Thus, more fuel enters carburetor opening 500 when the effective carburetor opening is increased by moving slider or sliders 8000. Of course, more air will also enter the effective carburetor opening 500 as the sliders 8000 separate from each other or the slider moves away from the wall of the actual carburetor opening 500.

Figure 19D:
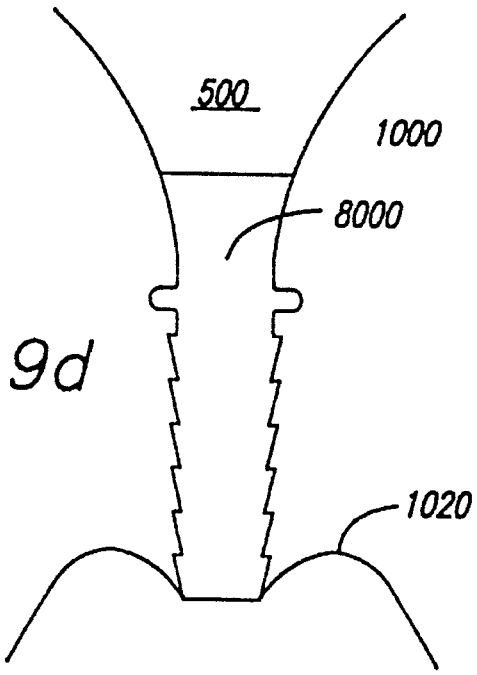
FIG. 19*d* is a view of FIG. 19*c* taken along line A—A and showing a modifed carburetor with shoulders as disclosed in FIG. 19*a*.

FIG. 19*d* is a sectional view of a carburetor opening 500 with sliders 8000 therein. This figure is a view taken along line A—A of FIG. 19*c* and shows a carburetor opening like that shown in FIG. 19*a* with sliders 8000 therein.

In FIG. 19*e*, a wedge-shaped, bullet-like power vapor nozzle 5000 is seen slidably engaged on either side with a slider 8000. Slider 8000 is slidably engaged with respect to the internal walls of carburetor opening 500. Power vapor nozzle 5000, rather than being circumferential in shape as in FIGS. 18*a* and 18*c* is wedge-shaped, tip 5010 forming a crest as it extends back along the length of carburetor opening 500. Each slider 8000 can move with respect to the side walls of carburetor opening 500 and power vapor nozzle 5000 to expose more openings for fuel and allow more air to pass through carburetor opening 500.

The top view of FIG. 19*e* shown in FIG. 19*f* depicts this arrangement. In horizontal cross section, carburetor opening 500 can be rectangular, circular, or otherwise shaped. FIG. 19*g* is a modification of FIGS. 19*e* and 19*f* in that each slider 8000 is comprised of two pieces as shown in FIG. 19*c*.

Figure 19H:
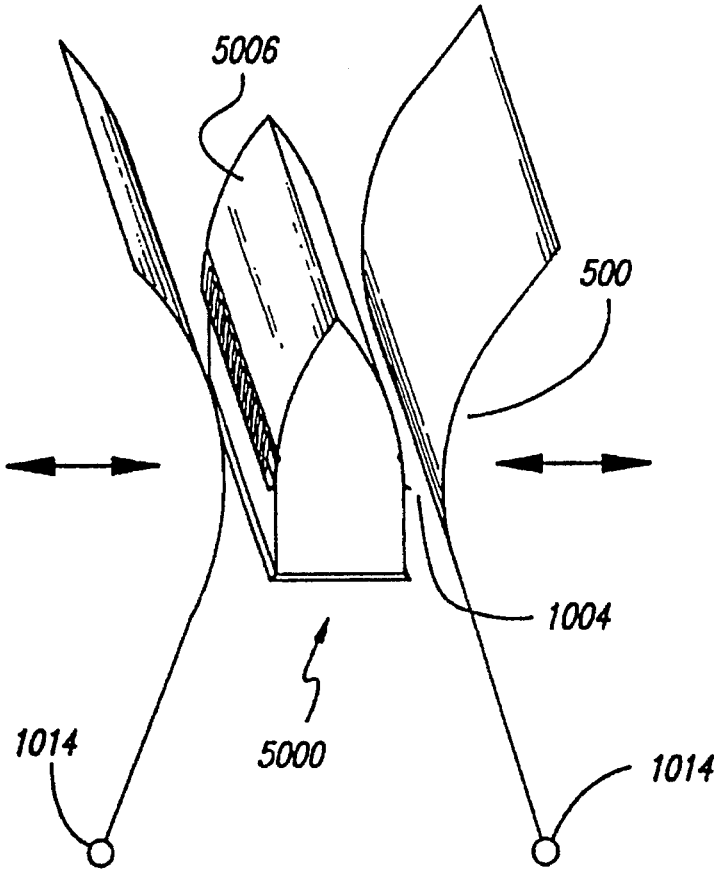
FIG. 19*h* is a side view of a variable carburetor opening with a bullet-like power vapor nozzle mounted therein in known manner.

FIG. 19*h* combines the power vapor nozzle 5000 of FIG. 19*e* with the variable carburetor opening of FIG. 18*f*. Sliders 8000 are not present here since the variable venturi of FIG. 18*f* obviates the need for them. Air openings 5012 of power vapor nozzle 5000 in this figure as well as all others are situated at or near the point of maximum pressure 504 in carburetor opening 500. Power vapor nozzle 5000 is held within variable carburetor opening 500 by means of its connection to fuel line 2000 or injector nozzle 6002 which extends into crown 5006.

Figure 19I:
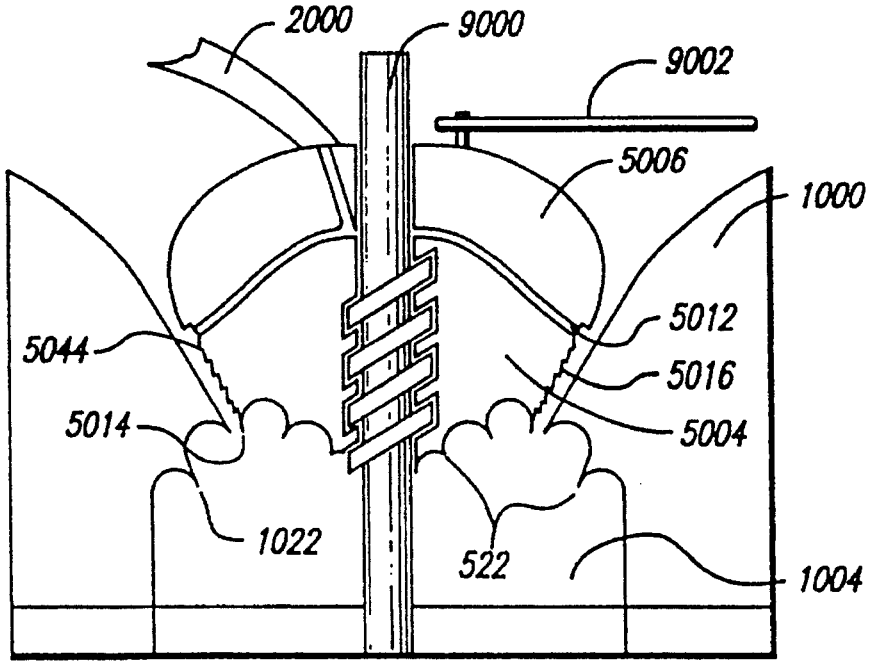
FIG. 19*i* is a side sectional view of a modified power vapor nozzle.

In FIG. 19*i*, power vapor nozzle 5000 is shown as heart shaped. Thus its widest diameters are at the top and its bottom narrows to a relative point. Carburetor opening 500 walls are spaced from and surround power vapor nozzle 5000 which is located fully within carburetor opening 500. Note that the walls of carburetor opening 500 parallel the shape of power vapor nozzle 5000 as it tapers from its top to its bottom. Fuel feed line 2000 feeds into the top side or crown 5006 of power vapor nozzle 5000. Extending generally centrally through power vapor nozzle 5000 and along the longitudinal center of carburetor opening 500 is a support shaft 9000 which is threadably engaged with the power vapor nozzle 5000. The threads of support shaft 9000 are square. The base of support shaft 5000 is connected to the inside walls of carburetor opening 500 but has a plurality of openings to enable the air passing through carburetor opening 500 to pass through the base. As can be observed, fuel feed line 2000 feeds into the power vapor nozzle 5000 which has a passageway that leads to opening or openings 5012. Openings 5012 are here located at or below the point of maximum pressure drop 504, that is at the point of narrowest diameter within carburetor opening 500. Opening 5012 again divides power vapor nozzle into a crown 5006 and a tail piece 5004. Lip 5014 is present on the underside of opening 5012 or ledges 5044 and arched frames 5042 are present on the outside of openings 5012. Below lip 5014 or ledges 5044, power vapor nozzle 5000 forms a plurality of trailing edges 522 which extend around its circumference. Between the first trailing edge 522 and ledge 5044 or lip 5014 are scales 5016 or serrations or knurling. The inside wall of carburetor opening 500 also forms a plurality of circumferentially extending trailing edges 1022 generally opposite those formed on power vapor nozzle 5000. Also between the uppermost trailing edge formed on the inside of carburetor opening 500 and between ¼ to ½ inches below opening 5012 are scales 5016, serrations or knurling lining the inside surface of carburetor opening 500. An accelerator lever 9002 extends from the upper portion of crown 5006 of power vapor nozzle 5000. Power vapor nozzle 5000 is movable on support shaft 9000 in response to action of the accelerator lever 9002. Through such movement, the space between power vapor nozzle 5000 and the walls of carburetor opening 500, and in particular the space between opening 5012 and the walls of the carburetor opening 500 may be varied to affect the flow of fuel and air.

Figures 2, 20L:
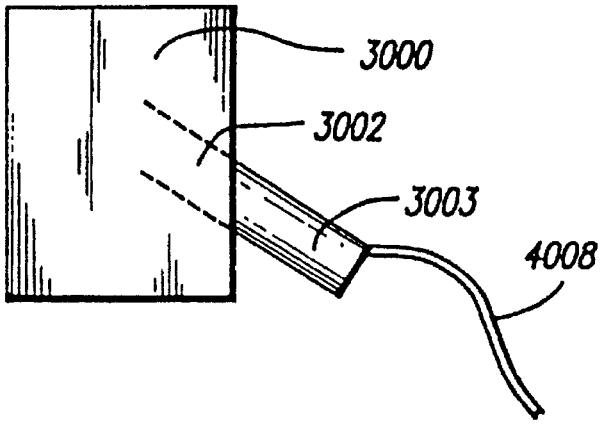

It is of note that a similar invention to this is set forth in U.S. Pat. No. 4,670,195 (Robson). The invention of this reference as shown in FIGS. 2 and 5 therein is of interest to the present invention if in the present invention power vapor nozzle 5000 were turned upside down and instead of the scale-shaped lip 5014 of the present invention a flat ledge were used. However, the flat ledge, the lack of trailing edges and scales allows fuel to pool and film on the surfaces. Further, the reversals of diameter by turning the power vapor nozzle upside down is very detrimental. The fuel comes out above the widest point of the power vapor nozzle and is thereby forced to ride the surface of the power vapor nozzle which is a smooth expanding surface. The fuel will therefore become a film on this surface, negating the efficiency of the device. Also, the fuel is coming out below the point of maximum pressure drop 504. By turning the power vapor nozzle upside down as shown in this '195 patent, the maximum venturi space available in the carburetor opening 500 is significantly less than in the present embodiment of FIG. 19*i*. Thus as the '195 patent power vapor nozzle moves, it begins to lose and then completely loses its point of maximum pressure drop in carburetor opening 500. By movement of the '195 patent power vapor nozzle, the shaping of opening 500 is reversed. This is not the case in FIG. 19*i* since the shape of power vapor nozzle 5000 reflects that of carburetor opening 500 where the two shapes interface. That is from the top of the opening 500 to the point of maximum pressure drop 504. Since the '195 patent power vapor nozzle 5000 does not parallel the shape of carburetor opening 500, beyond the point of maximum operation, the fuel efficiency of the device drops radically. This is not the case in the present invention.

In FIGS. 20*a* through 20*f*, the splash plate 4000 of this invention is depicted. FIG. B shows the splash plate 4000 connected to the accelerator pump 3000 of a carburetor. FIGS. 20*a* and 20*b* are particularly instructive in understanding this invention.

A standard accelerator pump nozzle 3000 extends through accelerator connection hole 4004 defined generally centrally below an upper straight edge 4001 of splash plate 4000. Fuel which passes through accelerator pump nozzle 3000 exits out of its mouth 3002, passes through the fuel hole 4002 defined to the side and downward of connection hole 4004 in the splash plate 4000, and impinges against the underside of the tip and body of the splash plate 4000. As can be seen in FIGS. 20*b* and 20*c*, splash plate 4000 is somewhat butterfly-shaped and preferably made of metal. FIG. 20*b* is a top view of splash plate 4000 whereas FIG. 20*c* is a side view. The two tips 4008 of splash plate 4000 are each rounded and separated on one side by the upper straight edge 4001. Tips 4008 are very wide in diameter and spoon-like in shape. When the fuel hits the underside of these tips 4008 at or before their point of maximum curvature or bend 4010, the fuel fans out into a wide spray. Preferably, the power vapor nozzles 5000 of the present invention are used with splash plates 4000. Some accelerator pump nozzles 3000 have an elongated pipe 3003 extending from mouth 3002. In such instances, opening 4002 may be made large enough to accommodate this pipe 3003 so that fuel splashes against bend 4010. This is seen in FIG. 20*l*-1. Otherwise, the device of FIG. 20*b* may be modified so that the tip 4008 arcs from the top of the pipe 3002 in front of its opening so that the fuel will still impinge on the underside portion of maximum bend 4010. In this instance, tip 4008 is formed with pump nozzle 3000 or retrofitted thereon, and the remainder of the body of 4000 is eliminated. This is seen in FIG. 20*l*-2.

To review what has been disclosed with respect to FIGS. 20*a* through 20*c*, the reader will note a splash plate 4000 having a first opening 4004 and a second opening 4002. When viewed from the top, the plate 4000 has a generally flat area 4005 where said first opening 4004 is defined. Tip 4008 extends from this area by means of a generally inverted v-shaped area, the v being made up of a first leg and a second leg which join at a sort of apex, the first leg extending to the flat area and defining therein the second opening 4002. The second leg extends to attach to a third relatively linear portion, the joinder of the third relatively linear portion and the second leg being at a general angle to define bend 4010. The splash plate can define more than one inverted v-shaped area as seen by way of example only in FIG. 20*b*.

FIG. 20*d* shows splash plate 4000 and accelerator pump nozzle 3000 cast as one piece. To accomplish this, fuel line 2000 must extend through the back of accelerator pump nozzle 3000 because the presence of the spoon-shaped base or tip 4008 prevents the drilling of the fuel hole opening from the front. A top view of FIG. 20*d* is seen in FIG. 20*e*. There, both tips 4008 of the splash plate are clearly seen extending at about a 45 degree angle from accelerator pump nozzle 3000, nozzle 3000 having two openings 2001 for the ejection of fuel.

If it is desired to incorporate splash plate 4000 with venturi 1000, then FIG. 20*f* shows such a modification. In FIG. 20*f*, accelerator pump nozzle 3000 stands independent of splash plate 4000. Instead, splash plate 4000 has been replaced by triangular protrusion 4006 and attached to the outside surface of venturi 1000. Protrusion 4006 is located just above the base of venturi 1000. Triangular protrusion 4006 is again spoon shaped, but here the fuel will hit the top of the spoon rather than the underside. Still, a wide spray of fuel will result from this situation. Fuel pours out of mouth 3002 of the accelerator pump nozzle 3000 and strikes triangular protrusion 4006 causing the fuel to spray out into carburetor opening 500. Although venturi 1000 is shown, it does not need to be included. Instead a mounting means in carburetor opening 500 for triangular protrusion 4006 is all that is required. FIG. 20*f* includes venturi 1000 as it would generally be found in an engine and triangular protrusion 4006 could be added as a retrofit to this item. Of course, if it is desired to keep venturi 1000, then venturi 1000 could be manufactured with triangular protrusion 4006. A further modification would be instead to use tip 4006 and place it on an arm extending from the base of venturi 1000. Then the fuel would leave accelerator pump 3000 and as in previous figures, splash on the back of splash plate 4006 at the point of curvature 4010 to spray out into carburetor opening 500. Preferably in the embodiments described in this paragraph the splash plate or triangular protrusion is located at or as close to as possible the point of maximum pressure drop 504.

To summarize the immediately preceding discussion, the reader will note a splash plate 4006 for use with a fuel nozzle 3000. The splash plate is generally triangular in shape in side view and extends from a venturi body 1000 having a base area and a top area opposite the base area. The splash plate angles outwardly from the venturi body 1000 to cause the body 1000 near the base to gradually widen such that the base of the venturi body 1000 is wider than the top.

As earlier discussed with respect to FIGS. 18*h* through 18*j*, splash plate 4000 may also be placed within an intake port 7000. Instances of such are depicted in FIGS. 20*g* through 20*j* and 20*m*.

In FIG. 20*g* splash plate tip 4008 is connected to a tube which extends from the end of an injection nozzle 6002. The two extend at an angle into intake port 7000. Fuel sprayed through injection nozzle 6002 splashes against the underside of the spoon-shaped tip 4008 at or above its point of maximum curvature 4010. This breaks the fuel into a wide spray which becomes homogenized in the air passing through intake port 7000. Tip 4008 extends generally centrally between the upper and lower walls of intake port 7000. Two rear views of the back of tip 4008 as taken along line B—B of FIG. 20*j* are seen in FIGS. 20*h* and 20*i*. The difference between the views is the shape and diameter of tip 4008. In one instance, tip 4008 is broad and almost round in shape. In the other instance, tip 4008 appears more like a teaspoon. The edges of tip 4008 may include scales 5016, serrations or knurling to prevent pooling or filming of fuel on these edges. It is also suggested that the underside of tip 4008 be roughened or scaled.

FIG. 20*j* is almost identical to FIG. 20*g* except that tip 4008 of splash plate 4000 is placed anywhere between the topmost edge of the intake port 7000 and its center. A rear view of FIG. 20*g* with tip 4008 being placed near the topmost edge of intake port 7000 is depicted in FIG. 20*k*. It is believed that optimum positioning for the maximum curvature point 4010 of tip 4008 is one quarter to one third of the distance down from the top of intake port 7000. Thus between the positions shown in FIGS. 20*g* and 20*j*. Again, while one intake port 7000 has been used to show several embodiments, it is to be understood that one device per intake port is the more likely configuration.

Figure 20M:
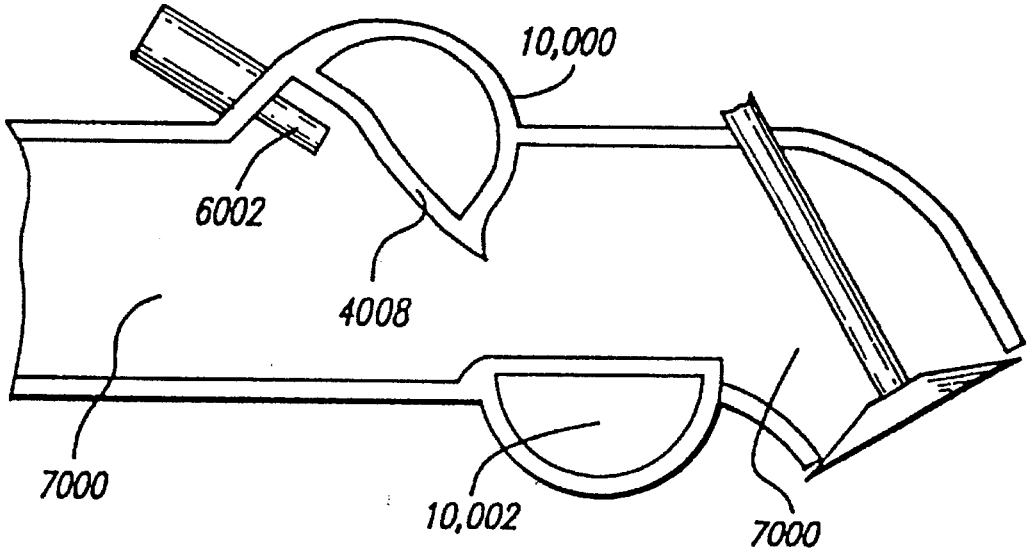
FIG. 20*m* is a side view of an intake port with a splash plate tip attached to an exhaust pipe.

In FIG. 20*m*, intake port 7000 is again penetrated by nozzle 6002. Tip 4008 is now connected downstream of nozzle 6002 formed as part of the outside lower edge of an exhaust pipe 10,000. Exhaust pipe 10,000 carries exhaust out of the engine and at the portion shown in FIG. 20*m*, the lower edge interrupts intake port 7000. The exhaust does not go into port 7000. Only the lower edge of the pipe 10,000 with tip 4008 extending therefrom protrudes into port 7000. The connection of tip 4008 to exhaust pipe 10,000 makes tip 4008 hot to facilitate the evaporation of the fuel that impacts it from nozzle 6002. The shape of tip 4008, curved as discussed in preceding figures, again causes the spray of fuel that hits it to fan out. Thus nozzle 6002 emits fuel against tip 4008 which is located downstream of nozzle 6002. The fuel sprays into a fan as its hits tip 4008 and evaporates at least to some degree within the air passing through port 7000. An option as to all of the tips 4008 is to manufacture each with a plurality of through openings that would operate with or without any knurling or scales used thereon.

Note is made of a second exhaust pipe 10,002 placed at the bottom of and against and formed as part of intake port 7000 downstream of exhaust pipe 10,000. Fuel that splashes from tip 4008 to this bottom area will be vaporized by the heat emanating through exhaust pipe 10,002. Again, the exhaust does not enter port 7000. The edge of the exhaust pipe merely causes the portion of port 7000 where it lies to angle inwardly.

Although exhaust pipe 10,000 and tip 6002 are shown at the top of exhaust pipe 7000, they could as well be placed at the bottom of the 7000 upstream of exhaust pipe 10,002.

Figure 21A:
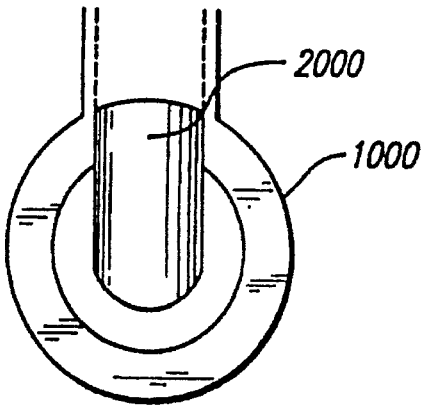
FIG. 21*a* is a top view of a fuel line extending into a venturi.
Figure 21B:
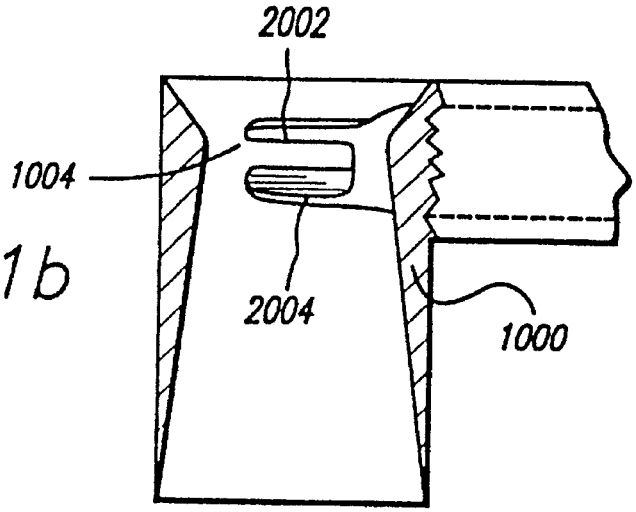
FIG. 21*b* is a side view of the fuel line of FIG. 21*a*.

Further embodiments of this invention are depicted in FIGS. 21*a* through 21*g*. In FIG. 21*a*, a top view of fuel feed line 2000 extending into venturi 1000 is shown without the use of a power vapor nozzle. However, an even more beneficial effect will be achieved if fuel feed line 2000 is combined with a power vapor nozzle 5000. FIG. 21*b* is a side view of line 2000. Fuel feed line 2000 protrudes centrally into venturi 1000 at or below the point of maximum pressure 1004. It is bifurcated at the end which is in venturi 1000 so that it has a top portion 2002 and a bottom portion 2004. Its tip is rounded from all angles. The underside of the top portion 2002 and the top side of the bottom portion 2004 face each other. Both have along their edges an opening 2006. Fuel sprays out of this opening 2006 into venturi 1000. Again, venturi 1000 is preferably lined with scales 5016 serrations or knurling and the end of fuel feed line 2000 that is bifurcated is also preferably covered with scales.

Figure 21C:
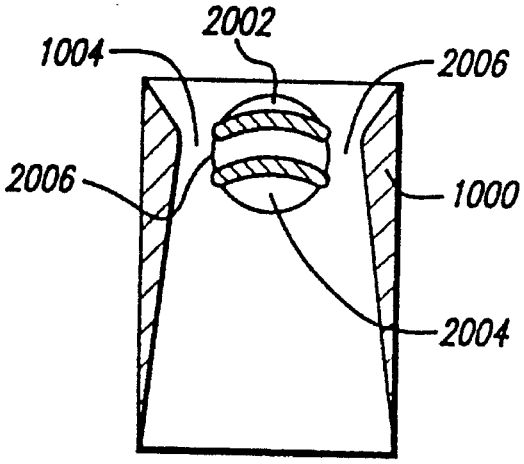
FIG. 21*c* is an end view of the fuel line of FIG. 21*a*.

FIG. 21*c* is a front view of the bifurcated end of fuel line 2000. From this view it is apparent that the top sides of both the upper and bottom portions 2002, 2004 arc downwardly with respect to the top of venturi 1000. In contrast, the underside of top portion 2002 arcs also downwardly so that it corresponds in shape to the upper portion, but the underside of bottom portion 2004 arcs upwardly to make the bottom of fuel feed line convex in shape.

Figure 21D:
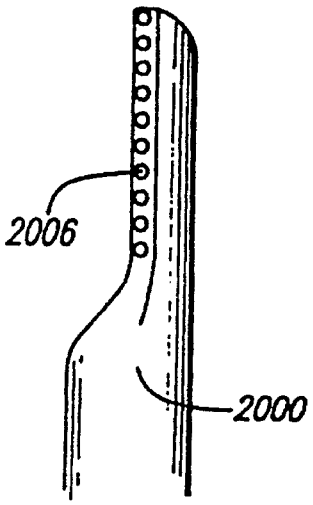
FIG. 21*d* is a perspective view of a modified fuel line.

FIG. 21*d* is a modified version of FIG. 21*b*, the bottom portion 2004 being omitted. This causes fuel feed line 2000 to have two diameters. The first diameter is at that portion which extends at least outside of the venturi 1000 opening. The second diameter, which is smaller than the first, is located between the tip which extends into venturi 1000 and the portion which extends at least outside of venturi 1000. Here a plurality of openings 2006 line the outside edge of the smaller diameter portion. These are well shown in both FIGS. 21*d* and 21*e*. The smaller diameter portion is located as described with respect to the end of fuel line 2000 in FIGS. 21*a* through 21*c*. A front view of the smaller diameter portion is depicted in FIG. 21*f*. It mirrors the view of upper portion 2002 in FIG. 21*c*.

Figure 21E:
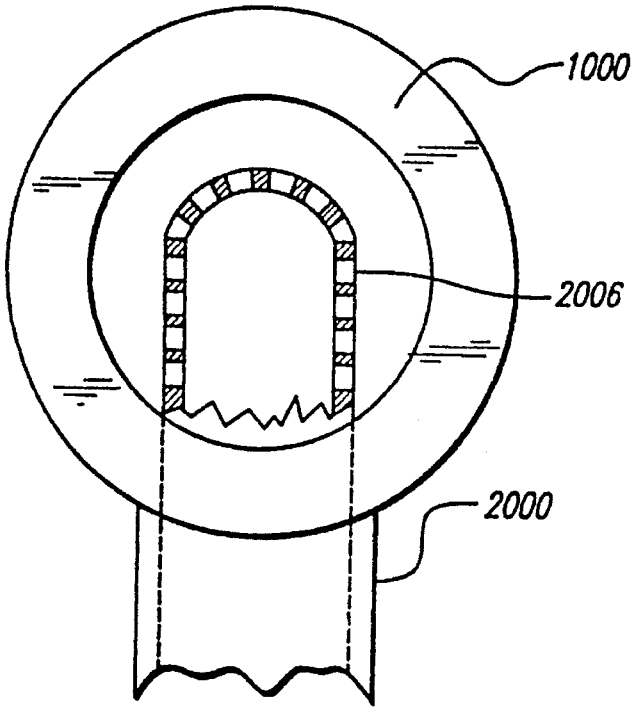
FIG. 21*e* is a top view of the fuel line of FIG. 21*d*.
Figure 21F:
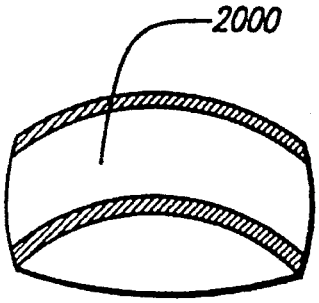
FIG. 21*f* is an end view of the fuel of FIG. 21*a*.
Figure 21G:
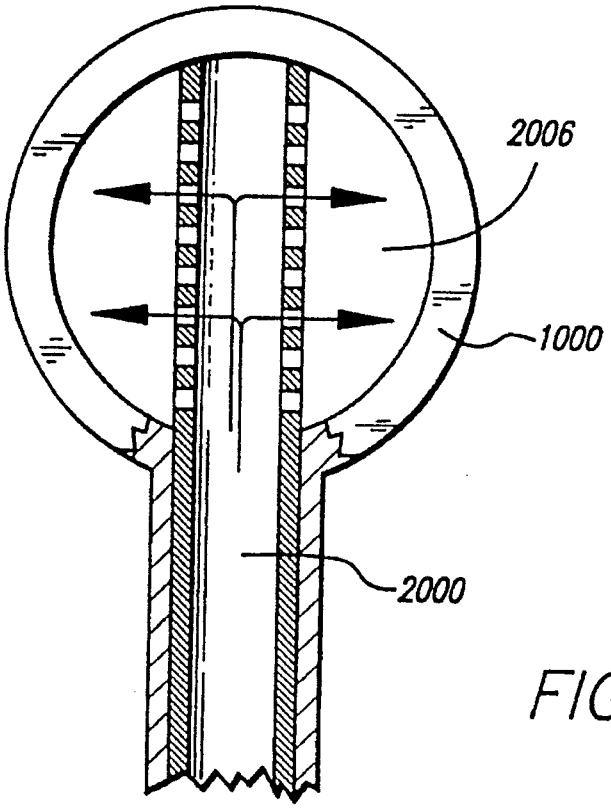
FIG. 21*g* is a top view of fuel line extending across the entire diameter of a venturi.

FIG. 21*g* is a modification of FIG. 21*e* in that the fuel feed line extends across the entire width of venturi 1000.

Although FIGS. 21*a* through 21*g* have been shown for use with a venturi 1000, it is conceivable that a venturi 1000 will not be desired. Then, these embodiments may be used directly in carburetor opening 500.

Figure 22A:
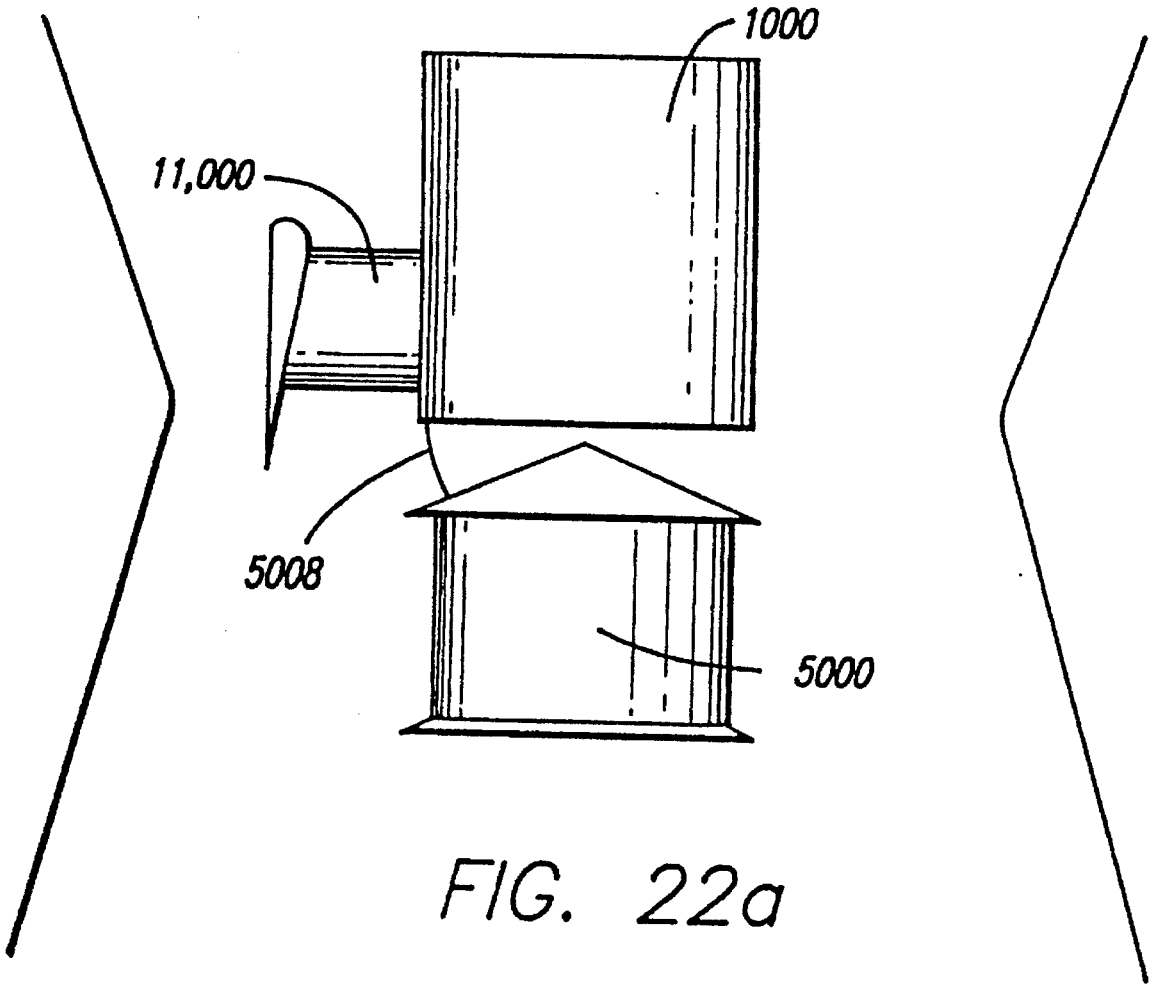
FIG. 22*a* is a side view of a venturi with an "I" shaped foil.
Figure 22B:
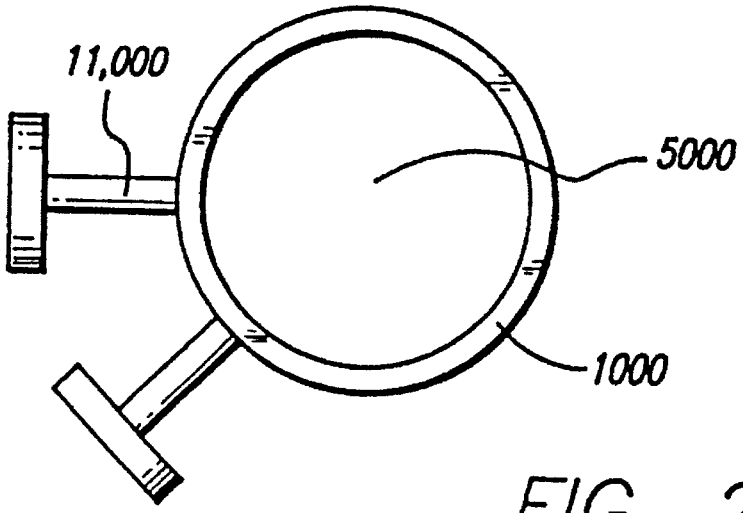
FIG. 22*b* is the top view of a venturi with a "T" shaped foil.

FIGS. 22*a* and 22*b* show the last embodiment of the invention. FIG. 22*a* is a side view. There, venturi 1000 lies above power vapor nozzle 5000. Power vapor nozzle 5000 connects to venturi 1000 by side walls 5008. Extending around the base of venturi 1000 are air foils 11,000. More air foils are desired in low speed applications than in situations where greater speed is desired. Air foils 11,000 extend from venturi 1000 to no more than half way between the inside walls of the carburetor openings 500 and the outside surface of venturi 1000.

FIG. 22*b* is top view of this embodiment. Each air foil 11,000 is "T" shaped. Instead each could be merely "I" shaped, omitting the end cross or "t" shaped, the end cross used instead to intersect the body of the foil. The "t" shape could also have a trailing knife like edge 11,001 on the outermost section of the "t". Each air foil may also be angled with respect to the central axis of venturi 1000.

While scales are preferred, a knurled or roughened surface may also be used as long as the form of roughening does not form troughs which capture and hold the fuel. Lip 5014 described herein is preferably comprised of a plurality of scales 5016 which extend from the surface of power vapor nozzle 5000 in a line to form a lip but which by the use of scales 5014 is formed so that a film of fuel does not form on that lip 5014. The present invention may be made of metal, nylon, or plastic or other suitable material. The number of attachment walls 5008 may vary but a minimal number is preferable, and the number must not favor fuel going in any one direction. As noted herein, where fuel injectors are described, fuel lines may be used instead and visa verse.

While power vapor nozzle 500 is shown as round or rectangular, it may also be configured as square or oval, and may have squared, oval, or other suitably shaped carburetor through opening 500. Also, any one of the described embodiments may be positioned in intake port 7000.

Although many parts have been described separately here they may instead be manufactured with each other. Examples may be the power vapor nozzle manufactured with the venturi and with the vaned insert plate. Further, parts that have been introduced as one piece could instead be manufactured for retrofit. Those skilled in art readily appreciate these modifications.

All embodiments herein may be used with fuel injection devices or fuel lines. When joining sides walls are used, the number chosen must be based upon obtaining optimum performance. That involves choosing a number that will not negatively affect the distribution of fuel through opening 5012.

All embodiments herein may be modified to incorporate features of other embodiments such as variable openings. When holding means for parts are not shown, obvious manners of connection will be used bearing in mind the end goal of maximizing fuel homogenization.

While down draft carburetors or injection systems have been presented herein, the present invention is equally well used in updraft and side draft carburetors or throttle bodies. At times, such use will require minor and obvious modifications that those skilled in the art will readily appreciate.

The invention herein is applicable to all engine sizes and types.

The present invention is claimed as follows.

1. A splash plate for connection to an accelerator pump nozzle of a carburetor, said splash plate having a bent surface and a first and second opening, said first opening receiving said accelerator pump nozzle, said second opening receiving fuel pumped through said nozzle, the fuel passing through said second opening and impinging upon the underside of said splash plate.

2. The splash plate of claim 1 wherein said splash plate defines a plurality of holes in the area where said fuel impinges on said plate.

3. The splash plate of claim 1 wherein the area of said splash plate where said first opening is defined is relatively flat.

4. The splash plate of claim 3 wherein the area of said splash plate where said second opening is defined is located at an angle with respect to the area where said first opening is defined.

5. A splash plate having a first opening and a second opening defined therein, said plate when viewed from a side comprising a first generally flat area in which said first opening is defined, a second inverted generally v-shaped area comprised of a first leg and a second leg attached to one end of said first leg to define the apex of said v-shape, the first leg of said v attaching at its other end to said flat area, said first leg defining the area in which said second opening is defined, and a third relatively linear area attaching to the end of said second leg not attached to said first leg, said third area lying at an angle with respect to said second leg so that fluid passing through said second opening will impinge against the joinder of said third area and said second leg.

6. The splash plate of claim 5 wherein said splash plate comprises more than one inverted v-shaped area, each inverted v-shaped area containing one second opening and each inverted v-shaped area connected to one third area.

7. A splash plate tip for extension from a pipe having an opening through which fuel may pass, said pipe having a top portion and a bottom portion opposite said top portion, said tip having: a shape that enables it to arc from the top of said pipe to in front of and spaced from said opening, the portion of the tip which lies in front of said opening being curved in shape and solid in construction and having a roughened surface and edges to the extent necessary to deter pooling of fuel thereon.

8. The splash plate tip of claim 7 wherein said curved shape is such that it defines a point of maximum curvature, said tip being positioned with respect to said opening so that fuel passing through said opening will impinge on said maximum point of curvature.

9. The tip of claim 8 wherein said portion which is curved in shape curves away from said pipe.

10. A protrusion for spaced placement from and in front of a fuel exit so that fuel exiting from said exit will impinge upon said protrusion, said protrusion having a front view and a side view such that said protrusion appears as generally triangular in said side view and generally curved in said front view, wherein said protrusion is placed such that fuel exiting said exit will impinge upon said curved portion, said protrusion having a roughened surface to the extent necessary to deter pooling of fuel thereon, said generally curved portion of said front view being curved such that the front view of said protrusion shows said protrusion to be concave in shape.

11. The protrusion of claim 10 wherein said curved portion of said front view has a point of maximum curvature, said protrusion being placed such that said fuel impinges primarily on said point of maximum curvature.

12. The splash plate of claim 1 wherein said plate and said accelerator pump are formed as one piece.

* * * * *